US007216724B2

(12) United States Patent
Self et al.

(10) Patent No.: US 7,216,724 B2
(45) Date of Patent: May 15, 2007

(54) COUPLING FOR DUAL MEMBER PIPE

(75) Inventors: Kelvin P. Self, Stillwater, OK (US); Floyd R. Gunsaulis, Perry, OK (US); David R. Payne, Perry, OK (US)

(73) Assignee: The Charles Machine Works, Inc., Perry, OK (US)

( * ) Notice: Subject to any disclaimer, the term of this patent is extended or adjusted under 35 U.S.C. 154(b) by 368 days.

(21) Appl. No.: 10/878,482

(22) Filed: Jun. 28, 2004

(65) Prior Publication Data

US 2005/0029016 A1 Feb. 10, 2005

Related U.S. Application Data

(60) Provisional application No. 60/483,151, filed on Jun. 27, 2003.

(51) Int. Cl.
*E21B 4/06* (2006.01)

(52) U.S. Cl. ..... 175/19; 175/73; 175/320

(58) Field of Classification Search ..... 175/61, 175/73, 320, 19

See application file for complete search history.

(56) References Cited

U.S. PATENT DOCUMENTS

| | | | | |
|---|---|---|---|---|
| 3,945,444 | A * | 3/1976 | Knudson | 175/92 |
| 4,432,423 | A | 2/1984 | Lyons et al. | 175/75 |
| 4,683,964 | A | 8/1987 | Wenzel | 175/107 |
| 5,452,967 | A | 9/1995 | Fuller | 405/184 |
| 5,490,569 | A | 2/1996 | Brotherton et al. | 175/61 |
| 5,924,500 | A * | 7/1999 | Puttmann | 175/61 |
| 6,311,790 | B1 | 11/2001 | Gunsaulis et al. | 175/62 |
| 6,536,539 | B2 | 3/2003 | Merecka et al. | 175/62 |
| 6,585,062 | B2 | 7/2003 | Rozendaal et al. | 175/53 |
| 6,659,198 | B2 | 12/2003 | Camp | 175/53 |
| RE38,418 | E | 2/2004 | Deken et al. | 175/19 |
| 6,761,231 | B1 | 7/2004 | Dock et al. | 175/51 |
| 6,848,506 | B1 * | 2/2005 | Sharp et al. | 166/301 |
| 2003/0132034 | A1 * | 7/2003 | Sharp et al. | 175/62 |

FOREIGN PATENT DOCUMENTS

| | | |
|---|---|---|
| DE | 41 07 834 A1 | 9/1992 |
| EP | 0 674 093 A2 | 9/1995 |
| GB | 842 190 A1 | 7/1960 |

* cited by examiner

*Primary Examiner*—William P Neuder
(74) *Attorney, Agent, or Firm*—Tomlinson & O'Connell, PC

(57) ABSTRACT

A coupling assembly to interconnect an inner member and an outer member of a dual member drill string in torque transmitting engagement is disclosed. The coupling assembly is adapted to transmit torque input from both members to a downhole tool. In one embodiment, the coupling assembly comprises a connector sub that fixedly and non-fixedly couples both members. In another embodiment, the coupling assembly comprises a clutch mechanism to interconnect both members when the rotational speed of the outer member exceeds the rotational speed of the inner member. In another embodiment, the coupling assembly comprises a mechanism to couple both members by axial downhole movement of the inner member relative to the outer member. In another embodiment, the coupling assembly comprises a planetary gear system that interconnects both members to provide high torque to the downhole tool at relatively low output speed of the dual member drill string.

39 Claims, 18 Drawing Sheets

SECTION A–A

COUPLING FOR DUAL MEMBER PIPE

CROSS REFERENCE TO RELATED APPLICATION

This application claims the benefit of U.S. Provisional Application No. 60/483,151, filed on Jun. 27, 2003, the contents of which are incorporated herein fully by reference.

FIELD OF THE INVENTION

The present invention relates to the field of horizontal directional drilling, and more particularly but not by way of limitation, to a coupling for a dual member pipe to generate a torque output for transmission to a downhole tool of a horizontal directional drilling system.

SUMMARY OF THE INVENTION

The present invention is directed to a system of pipe sections comprising a plurality of pipe sections and a coupling assembly. The pipe sections are disposed in end-to-end engagement to form a drill string. Each pipe section has a rotatable outer member and a rotatable inner member. The rotatable inner member is situated within the outer member. Torque may be transmitted between the outer member of each pipe section and the outer member of an adjacent pipe section, and wherein torque may be transmitted between the inner member of each pipe section and the inner member of an adjacent pipe section. Finally, the coupling assembly is adapted to transmit torque between the outer member and the inner member of the pipe section at a downhole end of the drill string.

The present invention is further directed to a system for rotating a downhole tool comprising a plurality of pipe sections and a coupling assembly. The pipe sections are disposed in end-to-end torque transmitting engagement to form a drill string. Each pipe section has a rotatable outer member and a rotatable inner member situated within the outer member. The coupling assembly has a first end and a second end. The first end of the coupling assembly is operably connectable to a downhole tool, whereas the second end of the coupling assembly is operably connectable to the inner member and the outer member of the pipe section at a downhole end of the drill string. Additionally, the coupling assembly is adapted to receive a torque input from the inner member and a torque input from the outer member to generate a resultant torque output of the downhole tool.

In yet another aspect, the invention is directed to a horizontal boring system comprising a horizontal boring machine, a plurality of pipe sections, a coupling assembly, and a downhole tool. The horizontal boring machine has at least one drive system that is characterized by a first end and a second end. The first end of the drive system is connected to the horizontal boring machine. The plurality of pipe sections are disposed in end-to-end engagement forming a drill string such that the pipe section at an uphole end of the drill string is connected to the second end of the drive system.

Each pipe section in the drill string has a rotatable outer member and a rotatable inner member situated within the outer member. Torque may be transmitted between the outer member of each pipe section and the outer member of an adjacent pipe section. Additionally, torque may be transmitted between the inner member of each pipe section and the inner member of an adjacent pipe section. Further, the coupling assembly is adapted to transmit torque between an outer member and an inner member of the pipe section at a downhole end of the drill string, and the downhole tool is adapted to be in torque transmitting engagement with the coupling assembly.

In still another aspect, the present invention is directed to a horizontal boring system for use to drive a downhole tool. The horizontal boring system comprises a horizontal boring machine, a plurality of pipe sections, and a coupling assembly. The horizontal boring machine has at least one drive system that is characterized by a first end and a second end. The first end of the drive system is connected to the horizontal boring machine.

The plurality of pipe sections are disposed in end-to-end engagement to form a drill string such that the pipe section at an uphole end of the drill string is connected to the second end of the drive system. Each pipe section in the drill string has a rotatable outer member and a rotatable inner member situated within the outer member. Torque may be transmitted between the outer member of each pipe section and the outer member of an adjacent pipe section. Further, torque may be transmitted between the inner member of each pipe section and the inner member of an adjacent pipe section. Finally, the coupling assembly is adapted to receive a torque input from the inner member and a torque input from the outer member to generate a resultant torque output of the downhole tool.

BRIEF DESCRIPTION OF THE DRAWINGS

FIG. 6 is a perspective view of a downhole tool with a connector sub formed as an integral part of the downhole tool.

FIG. 11 is a perspective view of a coupling assembly comprising a locking mechanism constructed in accordance with the present invention. A portion of wall of an outer drive shaft of the coupling assembly has been removed in order to better display other components of the locking mechanism.

FIG. 13(*b*) is a partial cross-sectional view of a coupling assembly comprising a moveable spline connector constructed in accordance with the present invention. The moveable spline connection is shown in a second position in which only the outer drive shaft is connected to the downhole tool through a spline coupling.

FIG. 13(*c*) is a partial cross-sectional view of a coupling assembly comprising a moveable spline connector constructed in accordance with the present invention. The moveable spline connector is shown in a third position in which both the inner drive shaft and the outer drive shaft are connected to the downhole tool through spline couplings.

FIG. 16 is a sectional view of the planetary drive housing assembly shown in FIG. 15.

DETAILED DESCRIPTION OF THE PREFERRED EMBODIMENTS

Figure 1:
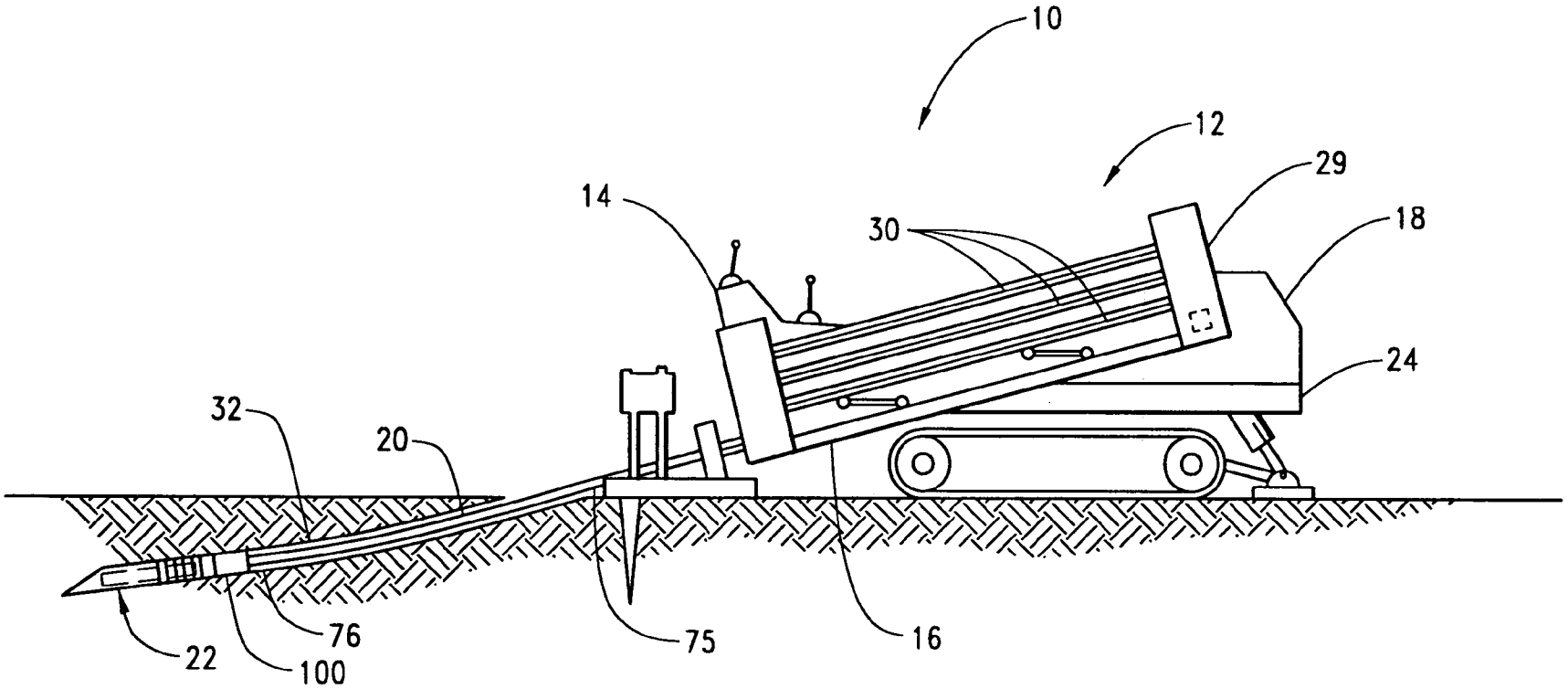
FIG. 1 is a diagrammatic representation of a horizontal directional drilling system constructed in accordance with the present invention.

Turning now to the drawings in general, and to FIG. 1 in particular, shown therein is a horizontal directional drilling system 10, that is constructed in accordance with the present invention. The horizontal directional drilling system 10 generally comprises a drilling machine 12, a control system 14, a pipe handling assembly 16, a drive system 18, a dual member drill string 20, and a downhole tool 22.

The drilling machine 12 preferably has a central frame 24 that supports the control system 14, a rotary machine of the drive system 18, and the pipe handling assembly 16. The frame 24 also supports a spindle 26 mounted on a carriage 28 (shown in FIG. 3). The carriage 28 can be advanced or retracted along the frame in a spindle connection area during drilling and backreaming operations. The pipe handling assembly 16 has a pipe storage device, such as a pipe rack 29, for storage of a plurality of dual member pipe sections 30. A pipe delivery system (not shown) may be located beneath the pipe rack 29 to transport pipe sections 30 between the pipe rack and the spindle connection area during drilling operations. Pipe sections 30 are added to or removed from the drill string 20 as needed, to extend or reduce the drill string 20 during drilling and backreaming operations. The drill string 20 thus comprises a plurality of dual member pipe sections 30 that are disposed in end-to-end engagement to form the drill string.

Figure 2:
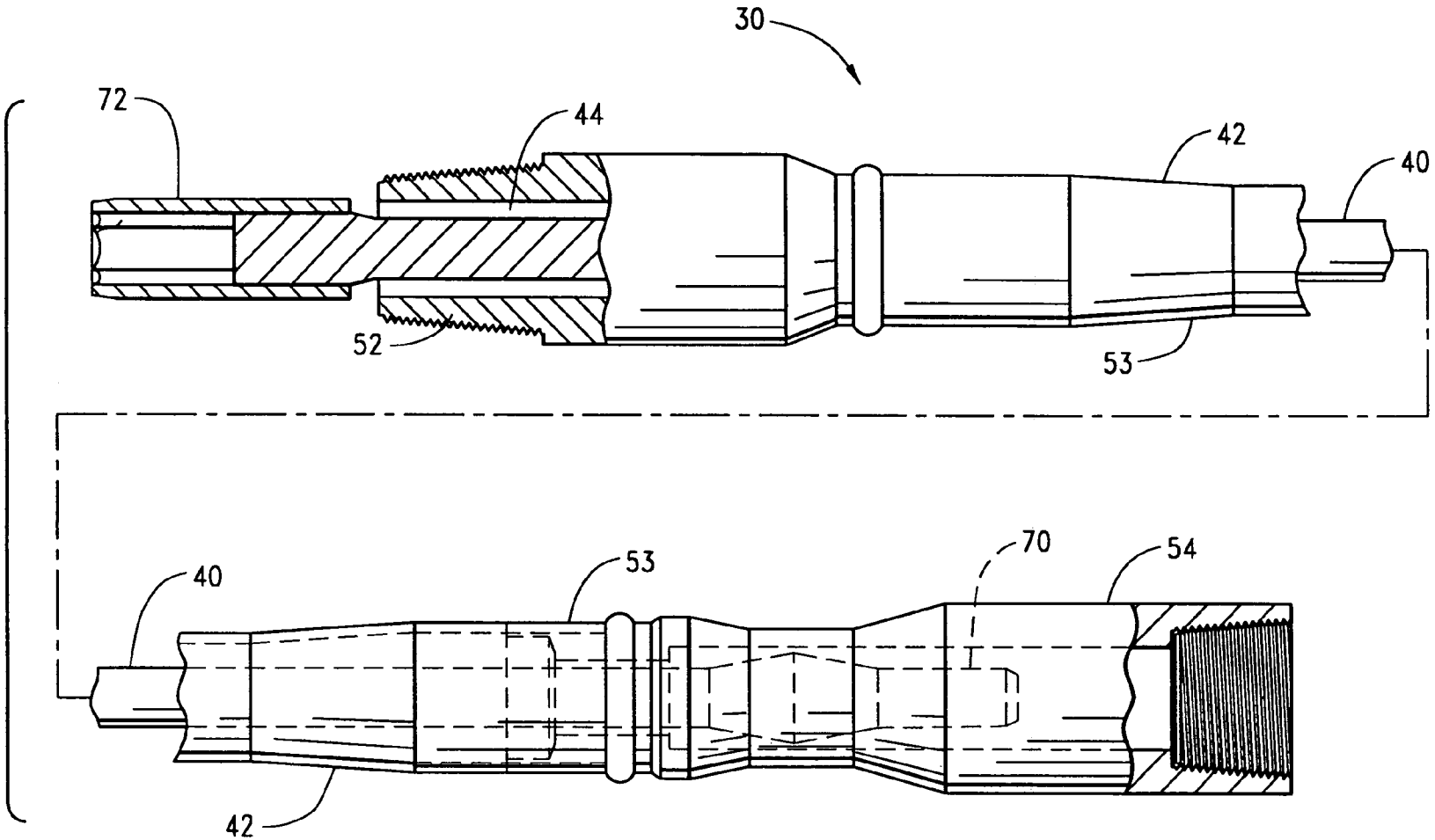
FIG. 2 is a fragmented, side elevational, partly sectional view of a pipe section used with a dual-member drill string.
Figure 3:
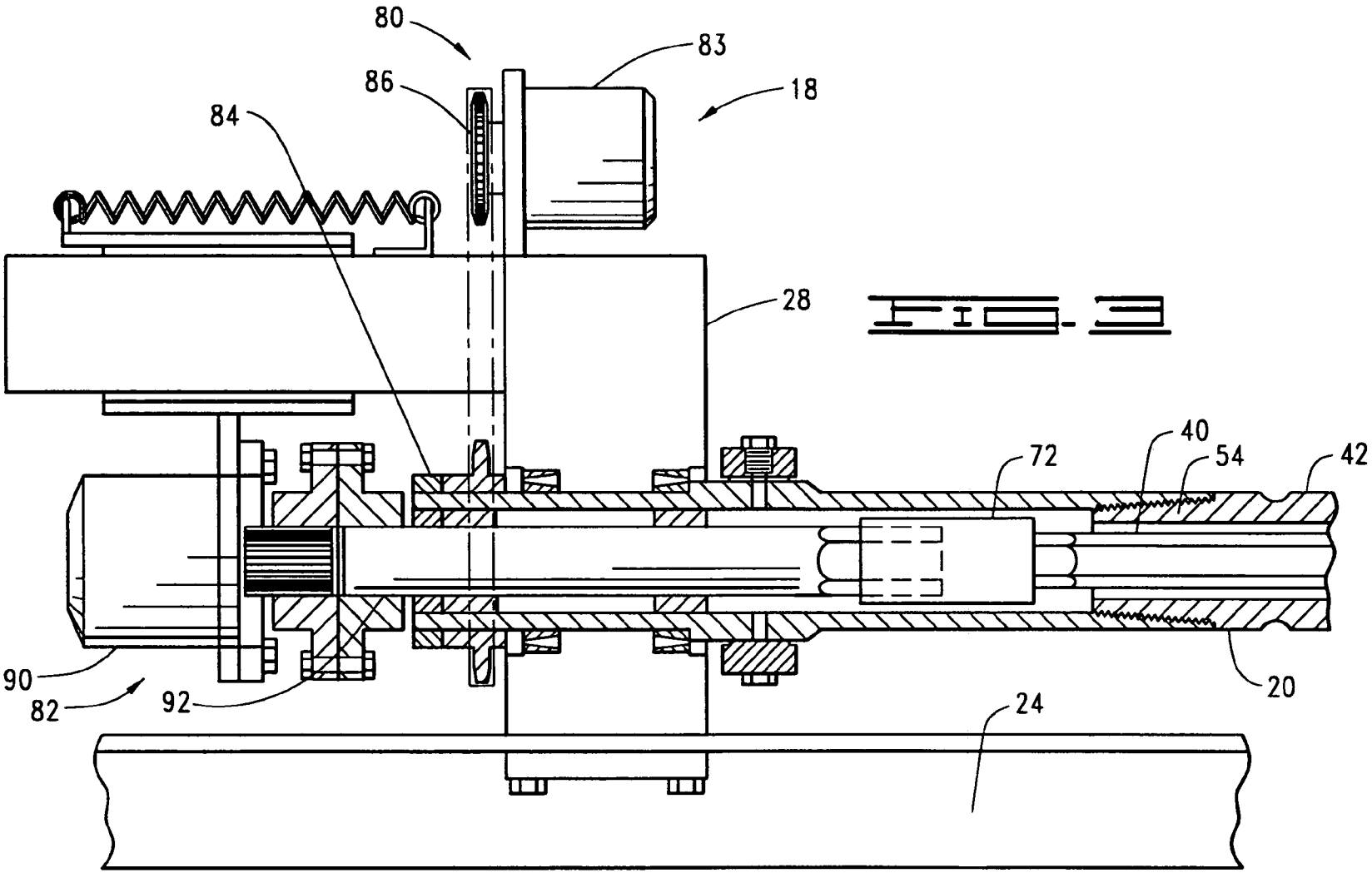
FIG. 3 shows a fragmented, side elevational, cross-sectional view of the rotary drive system of the present invention.

With reference now to FIGS. 2 and 3, each dual member pipe section 30 comprises a rotatable inner member 40 situated within a rotatable outer member 42. Preferably, the positioning of the inner member 40 within the outer member 42 creates an annular space 44 to facilitate flow of drilling fluid in the pipe section 30 between an outer surface of the inner member and an inner surface of the outer member. Alternatively, the inner member 40 may comprise a pipe or tubular section so that drilling fluid may pass through the inner member. As a result, a string of connected inner members 40 and outer members 42 defines a passageway extending the length of the dual member drill string 20 that allows for the flow of fluid through the drill string to the downhole tool 22.

In the preferred dual member pipe section 30, the rotatable outer member 42 is elongate and tubular. The outer member 42 comprises a pin end 52, a central body portion 53, and a box end 54. The pin end 52 and the box end 54 are threaded for connection to adjacent pipe sections 30. Preferably, the pin end 52 is provided with tapered external threads, and the box end 54 is provided with tapered internal threads. Thus, the box end 54 of the outer member 42 of one pipe section 30 is connectable in torque transmitting engagement to the pin end 52 of an adjacent like pipe section 30. The external diameters of the pin end 52 and the box end 54 of the outer member 42 may be larger than the external diameter of the central body portion 53 of the outer member.

The rotatable inner member 40 is preferably elongate and characterized by an external diameter less than the minimum internal diameter of the outer member 42. In the preferred embodiment, the inner member 40 is integrally formed and comprises a solid rod. However, it will be appreciated that in some instances the inner member 40 may be tubular instead of being a solid rod.

The inner member 40 of the dual member pipe section 30 is preferably provided with a non-threaded geometrically shaped pin end 70 and a box end 72. The box end 72 of the inner member 40 may be brazed, forged, welded or attached to the inner member 40 by any suitable means. The box end 72 has an internal contour which matches the geometric shape of the pin end 70. As a result, the box end 72 matingly receives the inner member 40 of the pin end 70 of the adjacent inner member 40 in slip-fit torque transmitting engagement. A preferred geometric shape for the pin end 70 and box end 72 of the inner member 40 is a polygon such as a hexagon, octagon, pentagon, etc.

For purposes of this application, "geometrically shaped" denotes any configuration which permits the pin end 70 to be slideably received in the box end 72, but which prevents rotation of the pin end relative to the box end when thus connected. Any geometric configuration that permits single action, connector-free, slip-fit engagement capable of transmitting torque between adjacent inner members 40 of the drill string 20 may be used. One such dual member pipe connection is described in U.S. Pat. No. 5,682,956, the contents of which are incorporated herein by reference. It will be understood that for purposes of this application, "geometrically shaped" does not include a perfectly circular shape as this would not allow torque transmission from one pipe section to the next. Additionally, as used herein, "connector-free" means the absence of any latch, pin, or other attaching device to retain the pin end 70 of the inner member 40 inside the box end 72 of an adjacent like inner member.

In the preferred dual member drill string 20, the pin end 70 of the inner member 40 is recessed within the box end 54 of the outer member 42, and the box end 72 of the inner member 40 protrudes beyond the pin end 52 of the outer member 42. This pipe section 30 structure is used to form the drill string 20 with the outer member 42 in pin-up configuration and the inner member 40 in pin-down configuration. Other configurations for the pin and box ends of the outer and inner members are anticipated, such that, for example, the pin end of the inner member may protrude from the pin end of the outer member and the box end of the inner member may be recessed within the box end of the outer member.

With reference again to FIG. 1, the assembled dual member drill string 20, is characterized by an uphole end 75 and a downhole end 76. The uphole end 75 of the drill string 20 is operably connected to the drilling machine 12 that imparts driving forces, such as rotation and thrust forces, to the drill string to produce the subterranean borehole 32. The downhole end 76 of the drill string 20 generally supports the downhole tool 22 that forms or finishes the borehole 32. Preferably, the downhole tool 22 is operatively connected to the inner members 40 of the pipe section 30 at the downhole end 76 of the drill string 20. The downhole tool 22 can thus be rotated by the inner members 40 and independently of the outer members 42. A slant face drill bit and a tricone bit exemplify downhole tools 22 that are commonly attached to the downhole end 76 of the drill string 20 to form the borehole 32 in the subterranean earth. Alternatively, a back-reaming tool is a downhole tool 22 that is commonly attached to the downhole end 76 of the drill string 20 to finish the borehole during withdrawal of the drill string 20 from the borehole 32 by cutting, expanding or packing, and thereby finally sizing the borehole. As used herein, "downhole tool" will be used to reference any tool operatively connected at the downhole end 76 of the drill string 20 and used in an application with a horizontal directional drilling machine 12.

With reference now to FIG. 3, in the preferred embodiment for the dual member horizontal directional drilling system 10, the assembled dual member drill string 20 and downhole tool 22 are driven by the drive system 18. The drive system 18 preferably comprises a plurality of rotary devices, and more preferably two independent rotary drive devices 80 and 82. Each rotary drive device 80 and 82 is operably connectable to the respective one of the members 40 and 42 of the pipe section 30 at the uphole end 75 of the drill string 20. Each rotary drive device 80 and 82 independently drives either the plurality of assembled inner members 40 or the plurality of assembled outer members 42 of the drill string 20. The rotary drive devices 80 and 82 may be, for example, hydraulic motors, variable speed motors, pneumatic motors, etc. One can also appreciate that in certain instances consistent with the invention, that at one instance the uphole drives 80 and 82 could be mechanically connected together or driven by a single motor.

As illustrated in FIG. 3, the drive system 18 preferably comprises the outer member drive group 80 for driving the plurality of outer members 42, and the inner member drive group 82 for driving the plurality of inner members 40.

The outer member drive group 80 is supported on the carriage 28 and comprises an outer drive motor 83, an outer spindle 84 and a torque-transmitting member 86. The outer drive motor 83 is operatively connected to the outer spindle 84 and transmits power and torque input to the outer spindle 84 through the torque-transmitting member 86. Preferably, the torque-transmitting member 86 comprises a sprocket and chain assembly having upper and lower sprockets. The outer spindle 84 in turn is threadably connectable to the outer member 42 of the pipe section 30 at the uphole end 75 of the drill string 20. In this manner, the outer spindle 84 transmits torque from the outer drive motor 83 to the plurality of outer members 42 comprising the drill string 20. However, any means for transmitting power and torque input from the outer member drive motor 83 to the outer members 42 may be used.

The inner member drive group 82 is adapted to be supported on the carriage 28 and comprises an inner drive motor 90 and an inner spindle 92. The inner drive motor 90 drives the inner spindle 92. The inner spindle 92 is connectable to the inner member 40 of the pipe section 30 at the uphole end 75 of the drill string 20. Preferably, the spindle 92 connects to the inner member 40 in a torque transmitting hexagonal slip-fit connection. However, any other type of connection that permits the transmission of torque between the inner spindle 92 and the inner member 40 at the uphole end 75 of the drill string 20 may be used. Thus, the inner drive motor 90 transmits torque to inner members 40 and, ultimately, to the downhole tool 22 during boring and backreaming operations.

Therefore, it will be appreciated that in accordance with the present invention, the drill string 20 torque is transmitted independently across both the outer members 42 and the inner members 40 of the dual member drill string. However, if the inner members 40 and the outer members 42 are made to rotate together, the amount of torque, which may be transmitted by the drill string 20 to the downhole tool 22 would include the torque input capabilities of both the inner members and the outer members.

The present invention provides for a coupling assembly 100 capable of interconnecting the inner members 40 with the outer members 42 so as to enable the inner members and the outer members to rotate together. Additionally, the coupling assembly 100 is configured to receive torque input from both the outer members 42 and the inner members 40 to generate a resultant torque output for transmission to the downhole tool 22. The coupling assembly 100 may transmit the torque output to the downhole tool 22 on an ongoing basis. Alternatively, the coupling assembly 100 may selectively transmit torque output to the downhole tool 22 as dictated by operating requirements.

Figure 4:
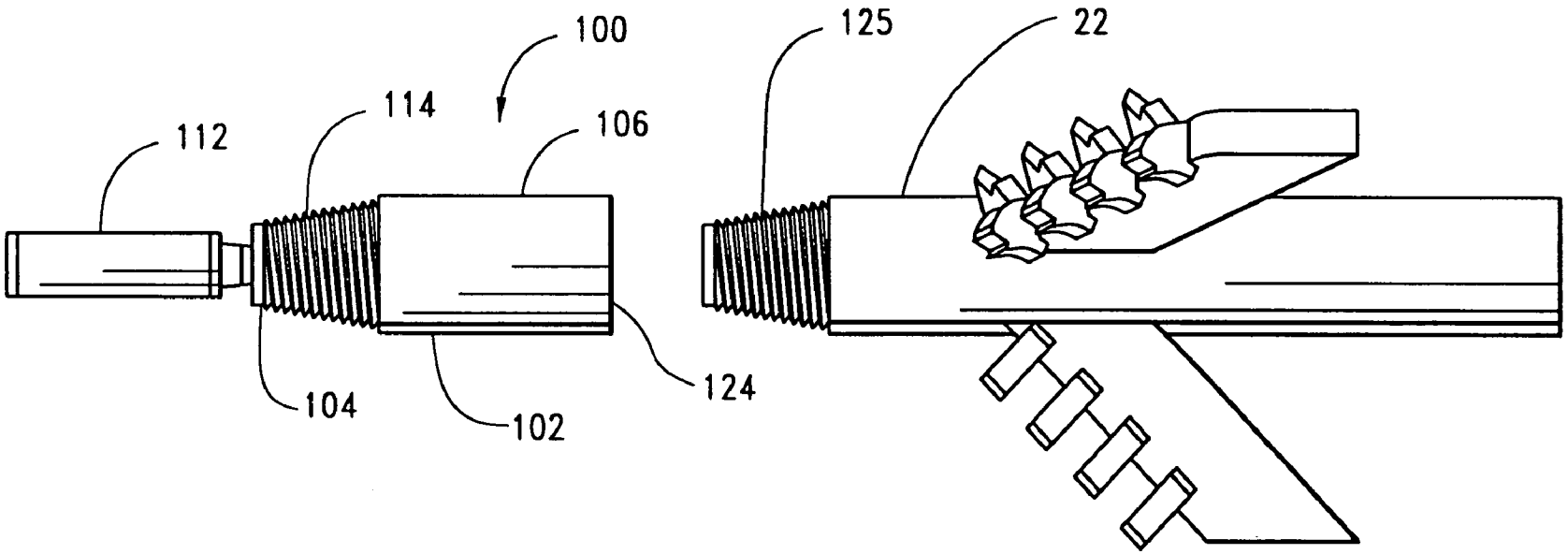
FIG. 4 is a side view of a coupling assembly comprising a connector sub that may be removably attached to a downhole tool.
Figure 5:
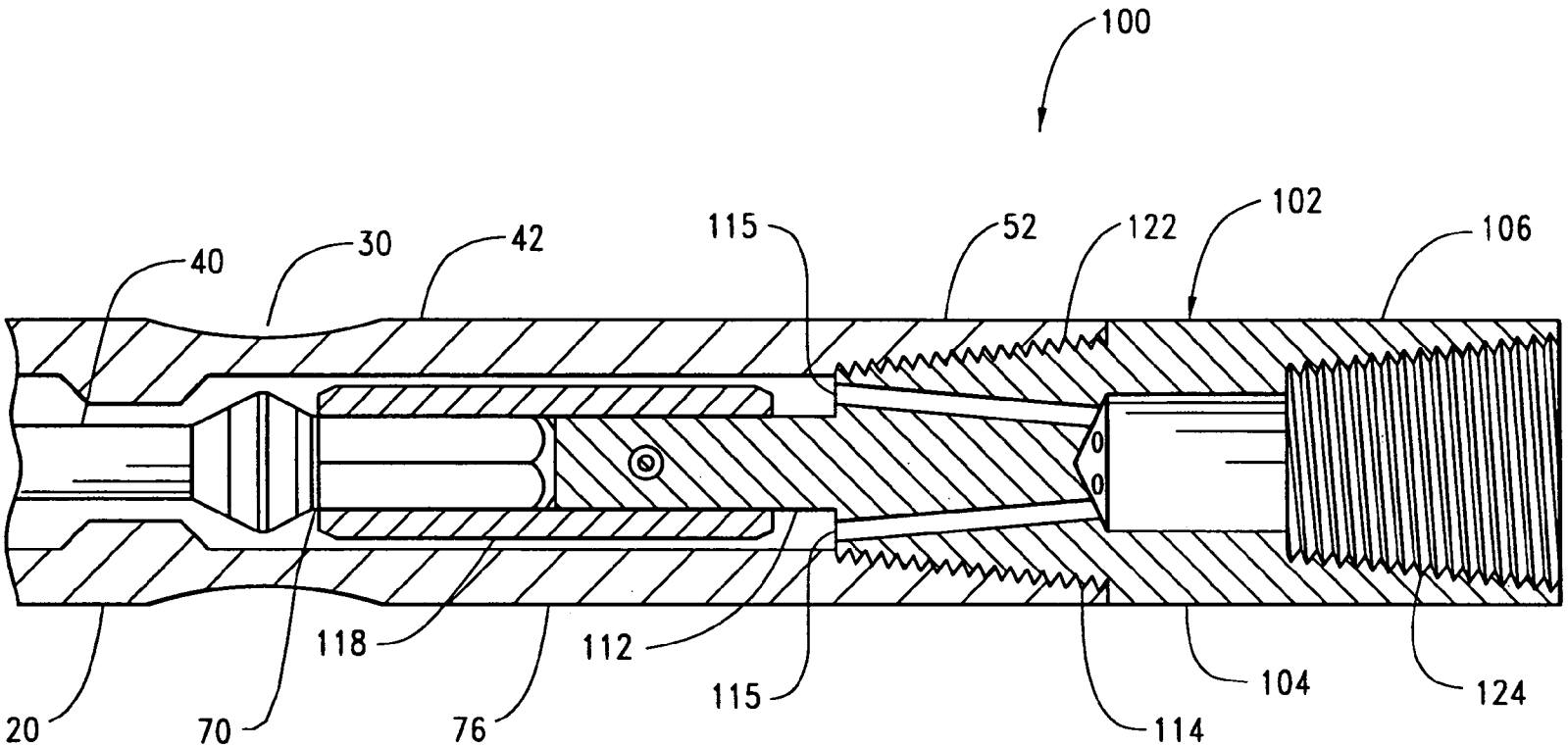
FIG. 5 is a cross-sectional view of the coupling assembly of FIG. 4 constructed in accordance with the present invention.
Figure 5:
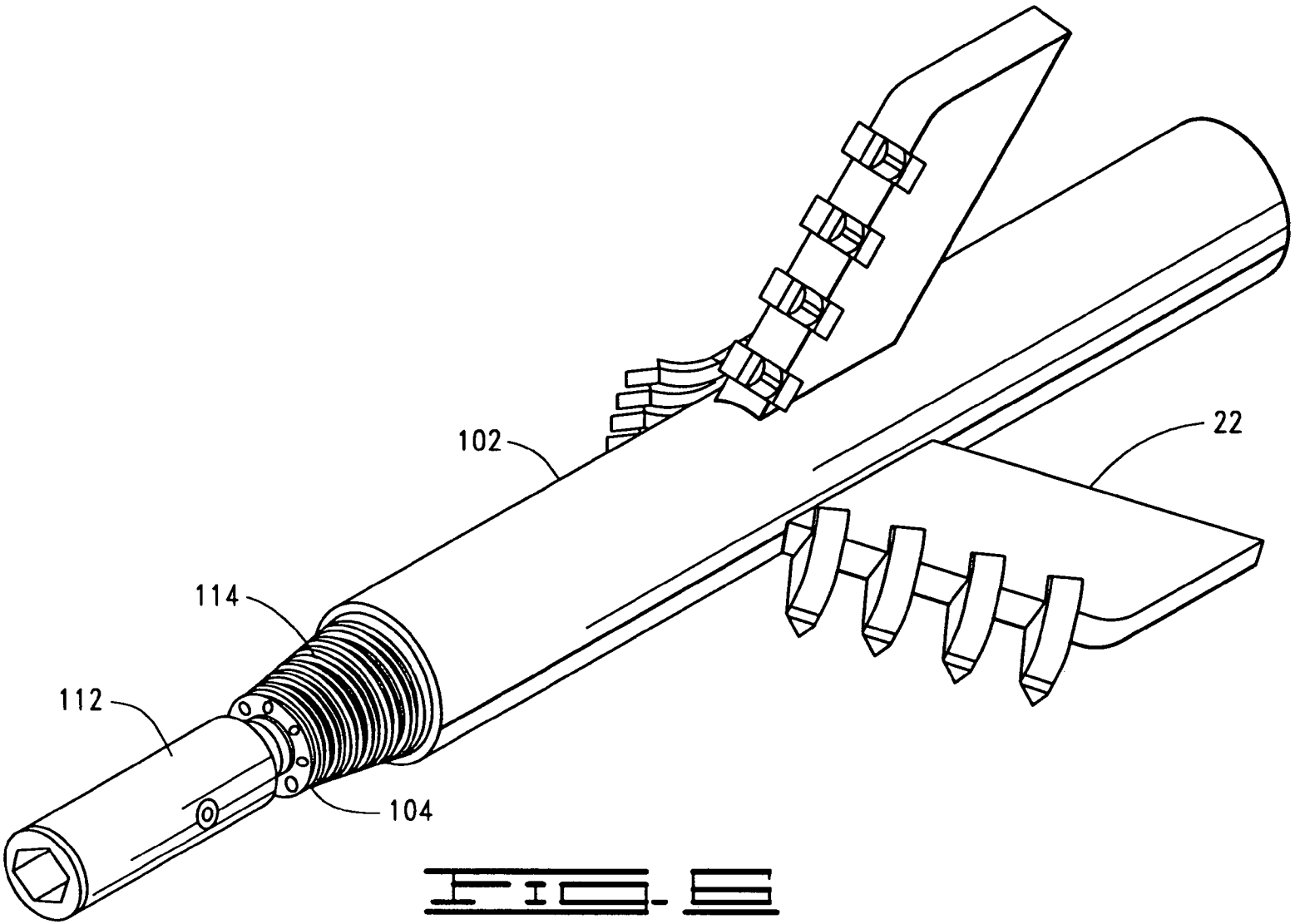

With reference now to FIGS. 4 and 5, there is illustrated therein a coupling assembly 100 such as a connector sub 102 capable of coupling the outer member 42 with the inner member 40. The outer member 42 and the inner member 40 are coupled in such a manner so as to transmit torque input on an ongoing basis between the outer member and the inner member of the pipe section 30 at the downhole end 76 (FIG. 1) of the drill string 20. A resultant torque output of the downhole tool 22 such as the backreamer shown in FIG. 4 is thus generated. Preferably, the connector sub 102 is made of steel. However, other materials, such as alloys or composite materials may be used.

The connector sub 102 preferably comprises an uphole portion 104 and a downhole portion 106. Preferably, the uphole portion 104 of the connector sub 102 is connected to the drill string 20 and the downhole portion 106 of the connector sub is connected to the downhole tool 22. The uphole portion 104 of the connector sub 102 preferably comprises an inner drive connector 112 and an outer drive connector 114. The connector sub 102 also is preferably characterized by a plurality of fluid passages 115 (shown in FIG. 5) which permit fluid to pass through the connector sub.

The outer drive connector 114 is adapted to connect with the outer member 42 of the pipe section 30 at the downhole end 76 of the drill string 20. In the preferred embodiment, the outer drive connector 114 comprises a threaded pin end. The outer drive connector 114 is connectable in torque transmitting engagement to the box end 52 of the outer member 42 of the pipe section 30.

The inner drive connector 112 extends from the outer drive connector 114. The inner drive connector 112 is adapted to connect with the inner member 40 of the pipe section 30 at the downhole end 76 of the drill string 20. Preferably, the inner drive connector 112 comprises a box end for connection to the pin end 70 of the inner member 40. More preferably, the inner drive connector 112 is geometrically shaped to receive the pin end 70 in a torque transmitting arrangement.

In the preferred embodiment, the inner drive connector 112 and outer drive connector 114 are torsionally fixed with respect to each other. More preferably, the connectors 112 and 114 are integrally formed as part of the connector sub 102. However, the connectors 112 and 114 may also be torsionally connected in other ways, such as by being welded or pinned.

With continued reference to FIGS. 4 and 5, the downhole portion 106 of the connector sub 102 is adapted to be connected to the downhole tool 22. Preferably, the downhole portion 106 comprises a box end 124 with tapered internal threads. The downhole tool 22 will preferably comprise a pin end 125 with tapered external threads. Thus, the box end 124 of the downhole portion 106 of the connector sub 102 may be threadably connected to the pin end 125 of the downhole tool 22, and may thereby be removably attached to the downhole tool.

Alternative arrangements are anticipated for torsionally fixing the downhole portion 106 of the connector sub 102 to the downhole tool 22. For example, the downhole tool 22 may be secured to the connector sub 102 with a pinning arrangement. In another embodiment, the downhole portion 106 of the connector sub 102 may be non-removably attached to the downhole tool 22. For example, the connector sub 102 may be formed as an integral part of the downhole tool 22 as illustrated in FIG. 6.

Figure 7:
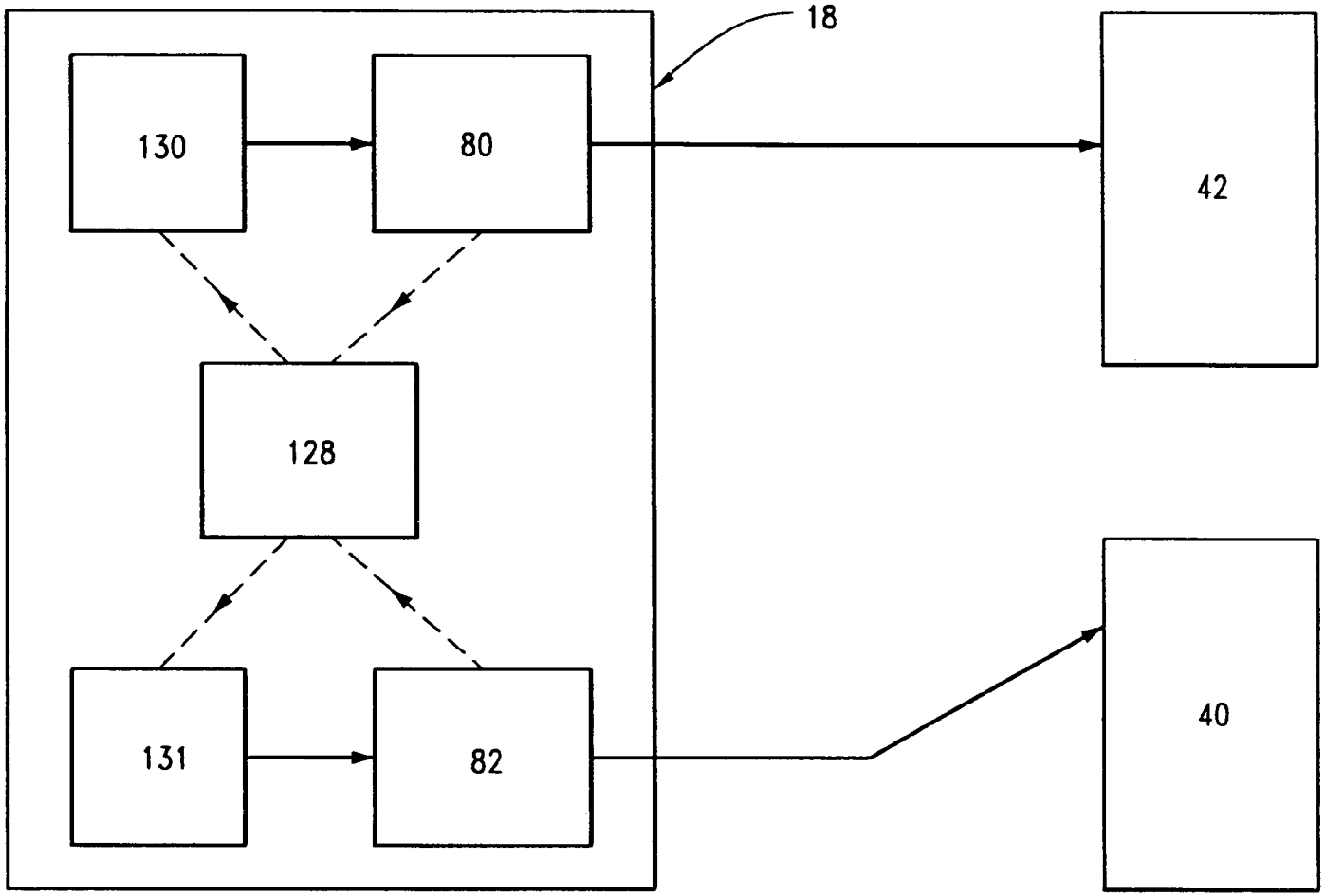
FIG. 7 is a block diagram of a drive system constructed in accordance with the present invention.

With reference now to FIG. 7, there is shown therein a schematic representation of the drive system 18 for use with the present invention. The drive system 18 preferably will have the capability of driving the outer members 42 and the inner members 40 of the drill string 20 at the same general rotational speed. As discussed above in reference to FIG. 3, the drive system 18 comprises the outer drive motor 80 and the inner drive motor 82. As shown in FIG. 7, the drive system 18 may also comprise a feedback control system 128, an outer drive motor load sense pump 130, and an inner drive motor load sense pump 131. Preferably, the outer drive motor 80 and the inner drive motor 82 are driven in response to the pressure feedback from the inner drive motor and rotational speed feedback from the outer drive motor.

The inner drive motor 80 and the outer drive motor 82 drive rotation of the inner members 40 and outer members 42 respectively. The outer load sense pump 130 and the inner load sense pump 131 are operatively connected to the motors 80 and 82, respectively, and regulate power input to the motors. Preferably, the motors 80 and 82 are hydraulic motors and the pumps 130 and 131 regulate flow of hydraulic fluid to the motors. This results in the hydraulic motors being driven at generally the same speed. Should one motor increase in speed slightly, the pressure in that loop will increase and the pump will react by reducing flow to that motor, thus regulating the motors to the same speed.

Alternatively, an automatic electronic control system 128 is operatively connected to the motors 80 and 82 and to the pumps 130 and 131. The control system 128 receives information about the operation of the motors 80 and 82 and communicates control information to the pumps 130 and 131. In the preferred embodiment, pressure sensors (not shown) on the inner drive motor 82 and outer drive motor 80 sense the rotation pressure of the inner and outer drive motors and sends corresponding pressure signals to the control system 128. Speed pickup sensors (not shown) on the outer drive motor 80 and the inner drive motors 82 senses the rotational speed of the outer drive motor and sends a corresponding speed signal to the control system 128. Alternatively, other sensors can be used to sense information about the operation of the motors 80 and 82.

The control system 128 receives the signals from the sensors on the motors 80 and 82 to control operation of the motors based on predetermined operating characteristics for the output of the drive motors. The control system 128 can then send control signals to the pumps 130 and 131 to produce the desired operating characteristics. For example, it may be desirable for the outer drive motor 82 to function as the primary source of torque to the drill string 20 and downhole tool 22. When the outer drive motor 82 reaches a maximum torque output, the inner drive motor 80 can provide additional torque output to the drill string 20 and downhole tool 22.

Other combinations for the output of the drive motors may be desired. However, the overall average torque output of both the inner drive motor 82 and the outer drive motor 80 would still be maintained. The overall average torque output is maintained because the second drive functioning as the additional source of torque output of the downhole tool 22 will be a factor only when the drive motor functioning as the primary source of torque output of the downhole tool reaches its maximum torque output.

Alternatively, the fluid streams to the inner drive motor 82 and the outer drive motor 80 may be supplied from a common pressurized source in order to rotate both the inner drive motor and the outer drive motor at the same rotational speed. As a result, the outer members 42 and the inner members 40 would both rotate at the same rotational speed and the resultant torque output transmitted by the connector sub 102 is the combined torque input of the inner drive motor 82 and the outer drive motor 80. It should be noted that the same rotational speed of both members 40 and 42 simply refers to an overall average rotational speed of both members. As a result, the rotational speed of the inner members 40 at any given instant may be different from the rotational speed of the outer members 42.

In addition to transmitting torque from the inner members 40 and the outer members 42 to the downhole tool 22, the connector sub 102 also prevents relative rotary motion between the outer members 42 and the inner members 40 of the drill string 20 at the downhole end 76 of the dual member drill string 20. Therefore, use of the connector sub 102 has a positive effect on the performance of the downhole tool 22 as the downhole tool now has the combined torque to advance through the formation without "hanging up". Additionally, wear on the pipe sections 30 is limited because as the downhole tool 22 has the torque needed to advance through rock, the "wind-up" of pipe sections in a long bore does not occur.

Figure 8:
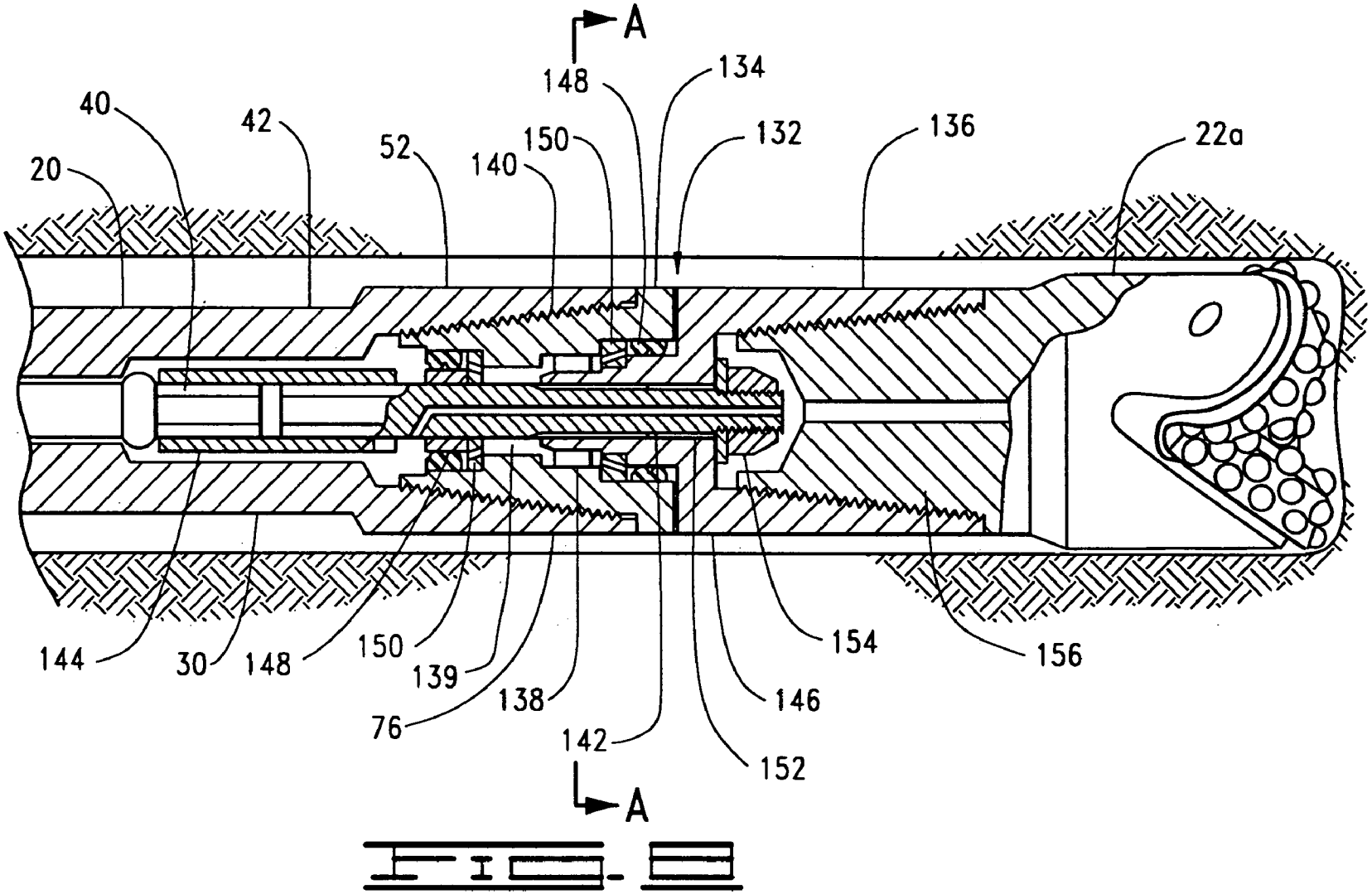
FIG. 8 is a cross-sectional view of a coupling assembly comprising an over-running clutch constructed in accordance with the present invention.
Figure 9:
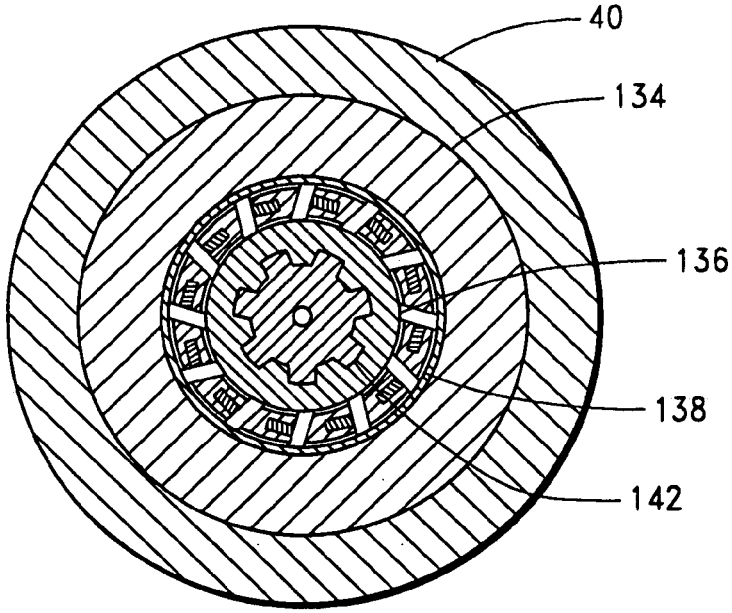
FIG. 9 is a perspective view of the coupling assembly of FIG. 8 comprising the over-running clutch constructed in accordance with the present invention, taken along cut-lines A—A in FIG. 8.

With reference now to FIG. 8, there is shown therein an alternative embodiment for the coupling assembly of the present invention. The coupling assembly 132 is adapted to selectively couple the inner member 40 and the outer member 42 of a dual member pipe section 30 at the downhole end 76 of the drill string 20. The downhole end of the coupling assembly 132 is operatively connected to a downhole tool 22*a*. As shown in FIGS. 8 and 9, the downhole tool 22*a* illustrated is a tricone bit used for drilling the borehole in rock. As with other embodiments of the present invention, the coupling assembly 132 may be used with any downhole tool 22 for use during boring or back-reaming operations.

The coupling assembly 132 comprises an outer drive 134, an inner drive 136, and a clutch mechanism 138. As will be discussed, when the clutch mechanism 138 is not engaged, the outer drive 134 and the inner drive 136 are disposed to rotate independently of one another. When the clutch mechanism 138 is engaged, the outer drive 134 and the inner drive 136 become coupled and rotate at the same speed.

Preferably, the outer drive 134 is generally cylindrical and defines a tubular open interior section 139. The outer drive 134 comprises an outer member connector 140 at an uphole end of the drive. The outer member connector 140 is adapted to be connected to the outer member 42 of the pipe section 30 at the downhole end 76 of the drill string 20. As shown in FIG. 8, the outer member connector 140 is a threaded pin end connector for mating with the threaded box end 52 of the outer member 42. More preferably, the outside diameter of the outer member connector 140 is substantially similar to the outside diameter of the box end of the outer member 42.

The inner drive 136 comprises a center shaft 142, an inner member connector 144, and a tool connector 146. The center shaft 142 passes through, and is disposed generally coaxially within, the interior section 139 of the outer drive 134. The center shaft 142 is retained independently rotatable within the interior section 139 by sets of seals 148 and bearings 150. The center shaft 142 may also have one or more fluid passages 151 that permit fluid passed through the drill string 20 to be transmitted to the downhole tool 22*a*.

The inner member connector 144 is attached at an uphole end of the center shaft 142 and extends beyond the outer member connector 140. The inner member connector 144 is preferably attached to the center shaft 142 by pinning or welding. Alternatively, the connector 144 may be torsionally fixed to the center shaft 142 by other means, or by integrally forming the connector with the shaft. The inner member connector 144 is adapted to connect to the inner member 40 of the pipe section 30 at the downhole end 76 of the drill string 20. As shown in FIG. 8, the inner member connector 144 is a box end connector adapted to receive the geometrically shaped pin end 70 of the inner member 40.

The tool connector 146 is attached at the downhole end of the center shaft 142 and is adapted to connect to the downhole tool 22*a*. As with the inner member connector 144, the tool connector 146 may be attached in any manner that permits transmission of torque from the shaft 142 to the tool connector. In the preferred embodiment shown in FIG. 8, the tool connector 146 includes a cylindrical uphole end 152 sized to receive the center shaft 142. A fastening nut 154 is threaded onto the shaft 142, securing the tool connector 146 to the shaft. A spline connection #? torsionally connects 146 to inner shaft 142. Alternatively, the tool connector 146 may be integrally formed with the central shaft 142, or otherwise fixed to the shaft.

The tool connector 146 is connected to the downhole tool 22*a* in a torque transmitting arrangement. Preferably, the tool connector 146 comprises a threaded box end for receiving a threaded pin end connector 156 of the downhole tool 22*a*. More preferably, the outer diameter of the tool connector 146 is substantially the same as the diameter of the outer drive 134. However, other arrangements for securing the downhole tool 22*a* to the tool connector 146 are anticipated. For example, the downhole tool 22*a* could be integrally formed with the inner drive 136 or with the coupling assembly 132.

The structure of the coupling assembly 132 and the relationship between the outer drive 134 and the inner drive 136 sometimes permit the drives to rotate independently of each other. Thus, as the inner members 40 and outer members 42 of the drill string 20 are rotated, the inner drive 136 and the outer drive 134 of the coupling assembly 132 rotate correspondingly. As will now be described, the clutch mechanism 138 of the coupling assembly 132 allows for the selective coupling of drives 134 and 136. The selective coupling of the drives 134 and 136 permits transmission of torque from both the drives and the drill string 20 to the downhole tool 22*a*.

With continued reference to FIG. 8, the clutch mechanism 138 is preferably positioned within the interior section 139 of the outer drive 134 and around the center shaft 142 of the inner drive 136. In the preferred embodiment, the clutch mechanism 138 is an over-running clutch, but any mechanism permitting selective coupling of the outer drive 134 and the inner drive 136 would also be suitable for use with the coupling assembly 132.

Preferably, the clutch mechanism 138 is press fit or otherwise secured to the wall of the interior section 139 such that no rotational slip is allowed between the outer drive 134 and the clutch mechanism. One skilled in the art will appreciate radial forces will keep the clutch 138 from rotating relative to the outer drive 134. Other matingly engaging mechanisms, such as splines or keyed arrangements, may also be used to prevent rotational slip between the clutch mechanism 138 and the drives 134 and 136.

As previously discussed, the structure of the coupling assembly 132 permits the outer drive 134 and the inner drive 136 to rotate independently of each other, and the clutch mechanism 138 permits the selective coupling of the drives. When the rotational speed of the outer drive 134 is less than the rotational speed of the inner drive 136, the clutch 138 does not engage and the inner drive 136 and the outer drive 134 rotate independently of each other. As a result, the downhole tool 22*a* receives torque input from inner drive 136, and, therefore, only from the inner members 40 of the drill string 20.

When the outer drive 134 rotates at a speed substantially equal to or greater than the rotational speed of the inner drive 136, the clutch mechanism 138 engages. When engaged, the clutch 138 will cause the inner drive 136 to rotate at substantially the same speed as the outer drive 134. Consequently, the clutch 138 effectively couples the inner members 40 and the outer members 42 of the drill string 20. As a result, the clutch 138 and the coupling assembly 132 permit torque input from the outer members 42 through the outer drive 134 to be transmitted to the downhole tool 22*a*.

If the speed of the outer drive 134 is decreased to be less than the rotational speed of the inner drive 136, or if inner drive speed is increased to be greater than that of the outer drive, the clutch mechanism 138 disengages. At this point, the clutch 138 slips or disengages the inner drive 136 from the outer drive 134. The inner drive 136, and the inner members 40 of the drill string 20, then, are again the sole source of torque input for the downhole tool 22*a*.

One skilled in the art will appreciate that when boring on a straight path use of the coupling assembly 132 with the clutch 138 in the engaged mode can provide significant advantages. Thus, with use of the coupling assembly 132 of the present invention, bores of longer distance may be bored as wind-up of the inner members 40 of the drill string 20 is limited in comparison to drill strings with uncoupled inner and outer members. This is because both the outer drive 134 and the inner drive 136 provide increased torque output to the downhole tool 22*a*. Use of the coupling assembly 132 also allows for use of large downhole tools because of the added torque that can be employed with the larger diameter outer members 42 of the drill string 20.

Figure 10:
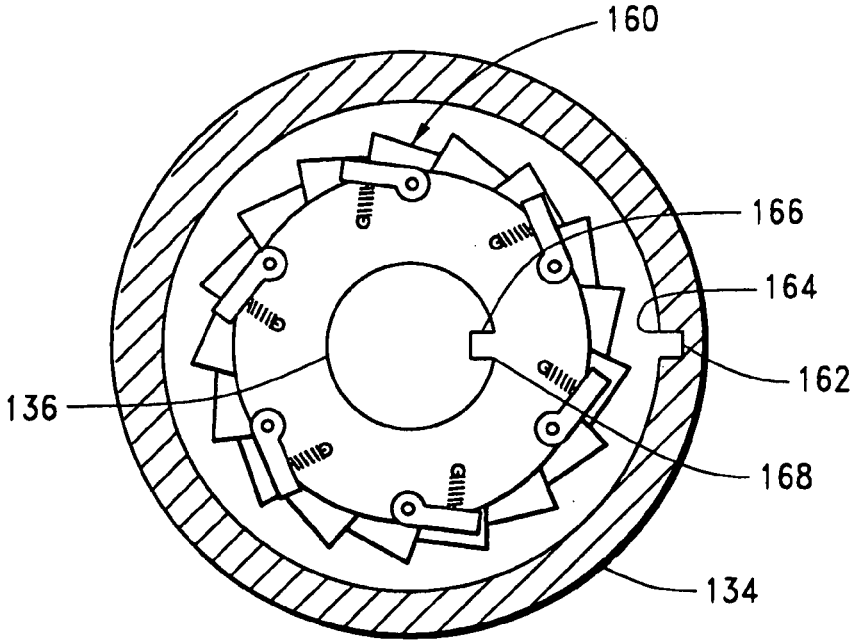
FIG. 10 is a cross-sectional view of a coupling assembly comprising a pawl clutch constructed in accordance with the present invention. The pawl clutch is arranged similarly to the over-running clutch of FIGS. 8 and 9.
Figure 1:
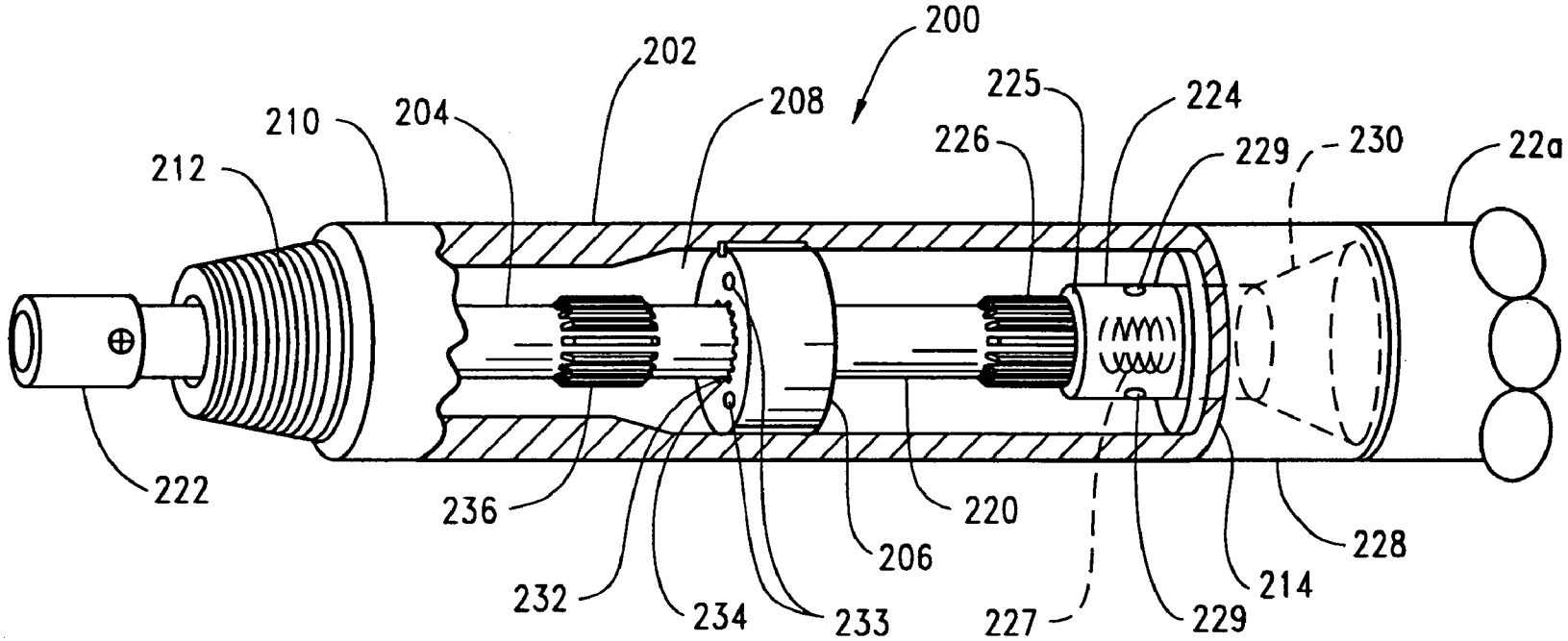

With reference now to FIG. 10, there is shown therein an alternative embodiment for a clutch mechanism 160 for use with the coupling assembly 132 shown in FIG. 8. Preferably, the clutch mechanism shown in FIG. 10 comprises a pawl clutch 160. As with the clutch mechanism 132 of FIG. 8, the pawl clutch 160 is positioned between the inner drive 136 and the outer drive 134. As shown in FIG. 10, the outer drive 134 may include a first key way 162, formed in the wall of the interior section 139 of the outer drive 134. The first key way 162 matingly receives a first key pin 164 on an outer wall of the clutch 160. Similarly, a second key way 166 is formed in the center shaft 142 of the inner drive 136. The second key way 166 matingly receives a second key pin 168 on an inner wall of the clutch 160. The key way 166 and key pin 168 prevent relative rotation between the inner drive 136 and the inner wall of the clutch 160. The key way 162 and key pin 164 prevent relative rotation between the outer drive 134 and the outer wall of the clutch 160. The pawl clutch 160 of FIG. 10 will operate in an engaged mode and a disengaged mode similar to the clutch mechanism 138 shown in FIGS. 8 and 9.

Figure 12:
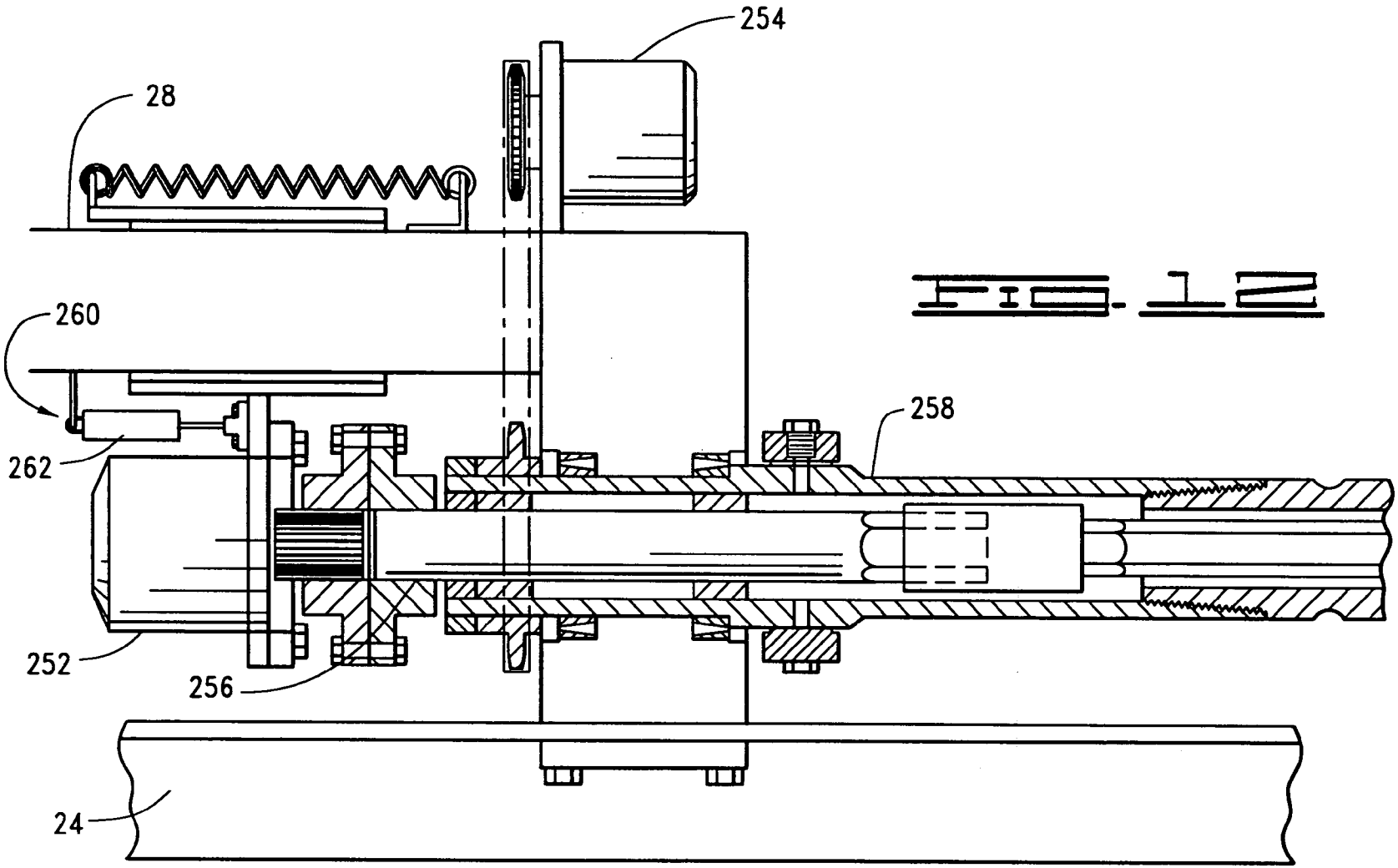
FIG. 12 is a cross-sectional view of the hydraulic mechanism which drives axial movement of the inner member relative to the outer member as shown in FIG. 11.

Turning now to FIGS. 11 and 12, there is shown therein another embodiment for a coupling assembly 200 and drive system 250 built in accordance with the present invention. The coupling assembly 200 will again serve to allow the inner members 40 and outer members 42 of the drill string 20 to be selectively coupled together.

The coupling assembly 200 comprises an outer drive or housing 202, an inner drive 204, and a locking mechanism 206. Preferably, the housing 202 is cylindrical and defines an interior chamber 208. An uphole end 210 of the housing 202 is adapted to be connected to the outer member 42 of the pipe section 30 at the downhole end 76 of the drill string 20. As shown in FIG. 11, the uphole end 210 of the housing 202 comprises a threaded pin end connection 212 for connecting with the box end 54 of the outer member 42. A downhole end 214 of the housing 202 is open ended to allow the inner drive 204 to pass through the housing, as yet to be described.

The inner drive 204 comprises a center shaft 220, an inner member connector 222, and a tool connector 224. The center shaft 220 passes through, and is disposed generally coaxially within, the housing 202. Preferably, the shaft 220 is cylindrical in shape. The center shaft 220 may be retained independently rotatable within the housing 202 by sets of seal and bearing arrangements (not shown).

The inner member connector 222 is attached at an uphole end of the center shaft 220 and extends beyond the pin end connection 212 of the housing 202. The inner member connector 222 is preferably attached to the center shaft 220 by pinning or welding. Alternatively, the connector 222 may be torsionally fixed to the center shaft 220 by other means, or by integrally forming the connector with the shaft. The inner member connector 222 is adapted to connect to the inner member 40 of the pipe section 30 at the downhole end 76 of the drill string 20. As shown in FIG. 11, the inner member connector 222 is a box end connector adapted to receive the geometrically shaped pin end 70 of the inner member 40.

The tool connector 224 is attached at the downhole end of the center shaft 220 and is adapted to connect to the downhole tool 22*a*. As with the inner member connector 222, the tool connector 224 may be connectable in any manner that permits transmission of torque from the shaft 220 to the tool connector. Preferably, the connection between the shaft 220 and the connector 224 will be such that permits axial movement of the shaft relative to the connector, for purposes yet to be described. As shown in FIG. 11, the tool connector 224 includes a cylindrical uphole end 225 sized to receive a downhole end 226 of the center shaft 220. More preferably, the center shaft 220 and the uphole end 225 of the connector 224 are geometrically shaped for connection in a pin/box torque transmitting arrangement. As illustrated, the downhole end 226 of the center shaft 220 comprises a pin end with splines for receipt in a matingly splined box end 225 of the connector 224.

More preferably, the tool connector 224 comprises a biasing spring 227 for urging the center shaft 220 axially uphole relative to the connector. Other biasing mechanisms are anticipated for use with the coupling assembly 200, provided the center shaft 220 and the tool connector 224 remain torsionally fixed regardless of the axial movement of the shaft.

A downhole end 228 of the tool connector 244 is adapted to be connected to the downhole tool 22*a*. The downhole end 228 of the tool connector 224 may be connected to the downhole tool 22*a* in any torque transmitting arrangement. Preferably, the downhole end 228 comprises a threaded box end 230 for receiving a threaded pin end connector of the downhole tool 22*a*. More preferably, the outer diameter of the downhole end 228 is substantially the same as the diameter of the housing 202. However, other arrangements for securing the downhole tool 22*a* to the tool connector 224 are anticipated. For example, the downhole tool 22*a* could be integrally formed with the inner drive 204 or with the coupling assembly 200. Preferably, the tool connector 224 also comprises fluid ports 229 to allow drilling fluid to pass through the connector to the downhole tool 22*a*.

The structure of the coupling assembly 200 and the relationship between the housing 202 and the inner drive 204 permit the drive to rotate independently of housing. Thus, as the inner members 40 and outer members 42 are rotated, the inner drive 204 and the housing 202 of the coupling assembly 200 rotate independently. As will now be described, the locking mechanism 206 of the coupling assembly 200 allows for the selective coupling of drive 204 and the housing 202. The selective coupling of the drive 204 and the housing 202 permits transmission of torque from the inner members 40 and the outer members 42 of the drill string 20 to the downhole tool 22*a*.

With continued reference to FIG. 11, the locking mechanism 206 is preferably cylindrical in shape, positioned within the housing 202 and around the center shaft 220. The locking mechanism 206 may have fluid passages 231 that allow drilling fluid to pass through the coupling assembly 200. Preferably, the locking mechanism 206 is press fit or otherwise secured to the wall of the housing 202 such that no rotational slip is allowed between the housing and the locking mechanism. Other matingly engaging mechanisms, such as splines or keyed arrangements, may be used to prevent rotational slip between the locking mechanism 206 and the housing 202.

The locking mechanism 206 defines an axial opening 232 through which the center shaft 220 passes and may include one or more fluid passages 233 to allow drilling fluid to flow through and past the locking mechanism. Preferably, the opening 232 defines an inner surface 234 adapted to engage the center shaft 220 in a locked and an unlocked mode. More preferably, the surface 234 of the opening 232 defines a spline arrangement for engaging a corresponding set of splines 236 fixed around the circumference of a portion of the center shaft 220. The splines 236 on the center shaft 220 will engage the surface 234 of the opening 232 when the shaft is axially advanced downhole in a manner yet to be described. Alternatively, the splines 236 can be arranged so that axial movement in either the uphole or downhole direction will result in a locked mode for the center shaft 220.

When the splines 236 on the center shaft 220 are not engaging the surface 234, the coupling assembly 200 operates in the unlocked mode and the housing 202 and the inner drive 204 can rotate independently. In the unlocked mode, only the inner drive 204, and consequently the inner members 40 of the drill string 20, drive rotation of the downhole tool 22*a*. When the splines 236 engage the surface 234, the coupling assembly 200 operates in the locked mode and the housing 202 and the inner drive 204 rotate together. In the locked mode, then, the rotational torque from both the inner members 40 and the outer members 42 of the drill string 20 will be transmitted to the downhole tool 22*a*.

FIG. 12 illustrates the drive system 250 modified for use with the coupling assembly 200. The drive system 250 of the present embodiment is preferably a dual rotary drive system, similar to the drive system shown in FIGS. 1, 3, and 7, for driving the inner members 40 and outer members 42 of the drill string 20. The drive system 250 comprises an inner member drive motor 252 and an outer member drive motor 254. The inner member drive motor 252 drives movement of an inner drive shaft 256. The outer member drive motor 254 drives movement of the outer drive shaft 258.

The drive system 250 also comprises an axial translating assembly 260 operatively connected to the inner drive motor 252. The translating assembly 260 preferably is adapted to axially or longitudinally move the inner drive motor 252 and the inner drive shaft 256 relative to the outer drive shaft 258. The translating assembly 260 preferably comprises a hydraulic piston and cylinder assembly 262. More preferably, the piston and cylinder assembly 262 is operatively attached to the inner drive motor 252 and secured to the carriage 28 of the drilling machine 12 (see FIGS. 1 and 3). As shown in FIG. 12, the cylinder assembly 262 is disposed to move the inner drive motor 252 and the inner drive shaft 256 relative to the carriage 28 and, consequently, the outer drive shaft 258.

The disposition of and connections for the piston and cylinder assembly 262 are intended to be exemplary only. Other structures and operations are anticipated for the translating assembly 260. For example, the piston and cylinder assembly 262 could be operatively connected to the inner drive shaft 256 or could comprise a gear and chain mechanism. Any structure permitting axial movement of the inner drive shaft 256 relative to the outer drive shaft 258 would be appropriate for use with the translating assembly 260 of the present embodiment. It is also anticipated that the translating assembly 260 may be actuated by the control system 14 or by an operator as needed.

The assembly 262 will preferably operate between a standard position and a forward position. Alternatively, the translating assembly 262 may operate between a plurality of positions such that the inner drive shaft 256 and the outer drive shaft 258 can be axially moved relative to each other. In the standard position of the present embodiment, the piston and cylinder assembly 262 is not extended and the drill string 20 is used in the conventional manner, with the inner members 40 and the outer members 42 of the drill string rotating independently of each other.

In the forward position as depicted in FIG. 12, the piston and cylinder assembly 262 extends, advancing the inner drive motor 252 and the inner drive shaft 256 forward. The forward movement of the inner drive shaft 256 results in the inner members 40 also moving forward, relative to the outer members 42. The movement of the inner members 40 results in a forward movement of the center shaft 220 of the coupling assembly 200. Forward movement of the center shaft 220 permits the splines 236 on the shaft to engage the inner surface 234 of the locking mechanism 206. It will be appreciated that the center shaft 220, and thus the inner members 40 of the drill string 20, may be rotated slightly to permit the splines 236 to matingly align with the inner surface 234. As previously discussed, when the center shaft 220 engages the locking mechanism 206, the inner members 40 and the outer members 42 of the drill string 20 will be coupled and the torque from both the inner drive shaft 256 and the outer drive shaft 258 can be transmitted to the downhole tool 22*a*.

Figure 13A:
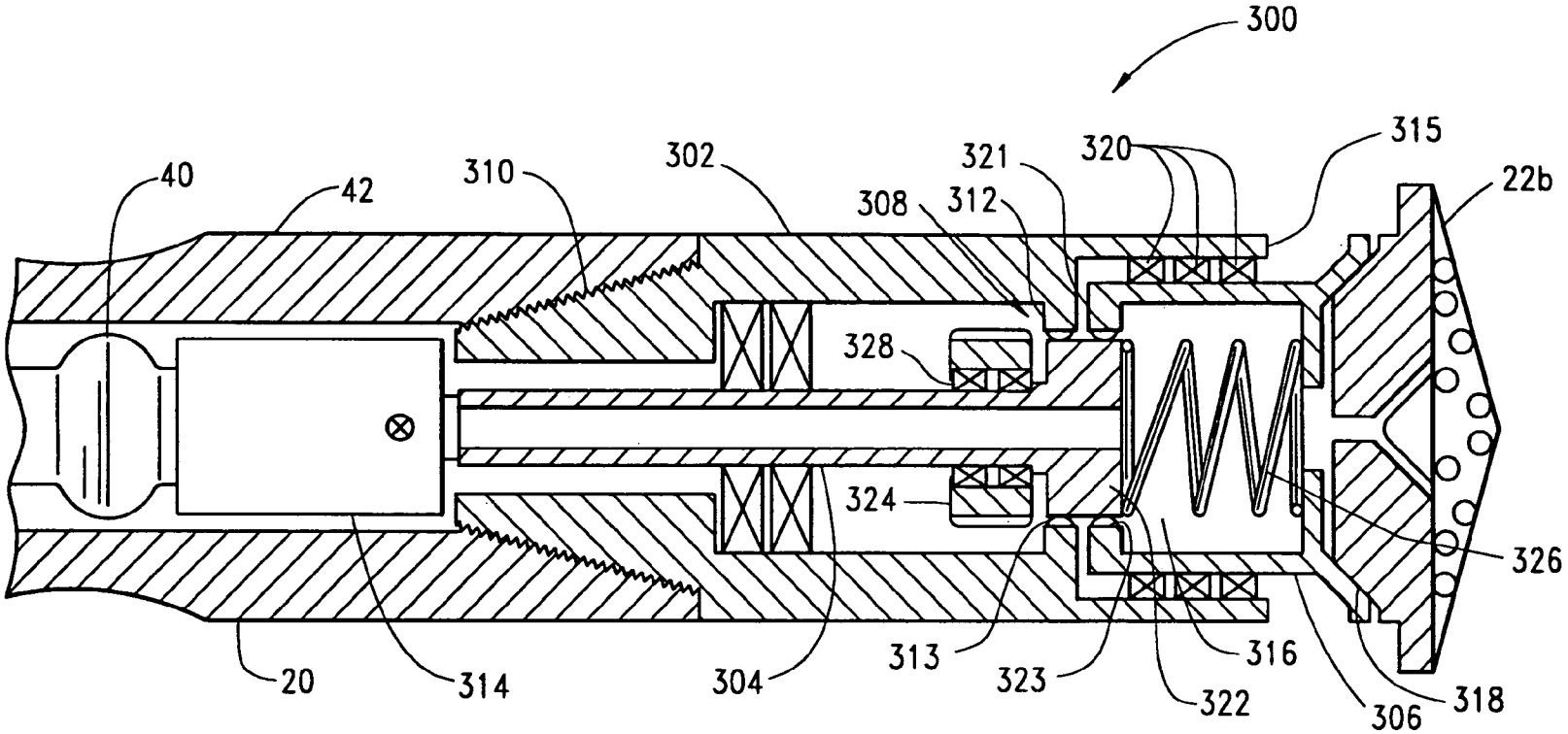
FIG. 13(*a*) is a cross-sectional view of a coupling assembly connected to a dual member drill string and comprising a moveable spline connector constructed in accordance with the present invention. The moveable spline connector is shown in a first position in which only the inner drive shaft is connected to the downhole tool through a spline coupling.
Figure 13:
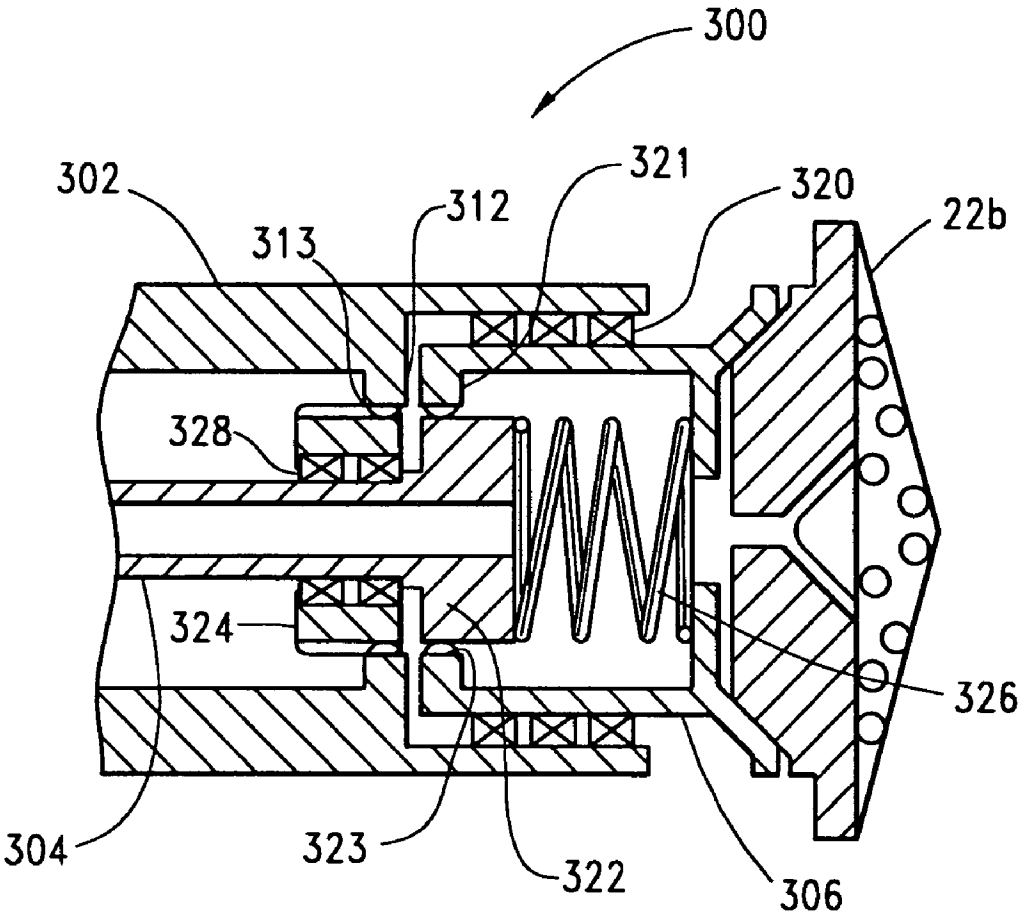
Figure 13E:
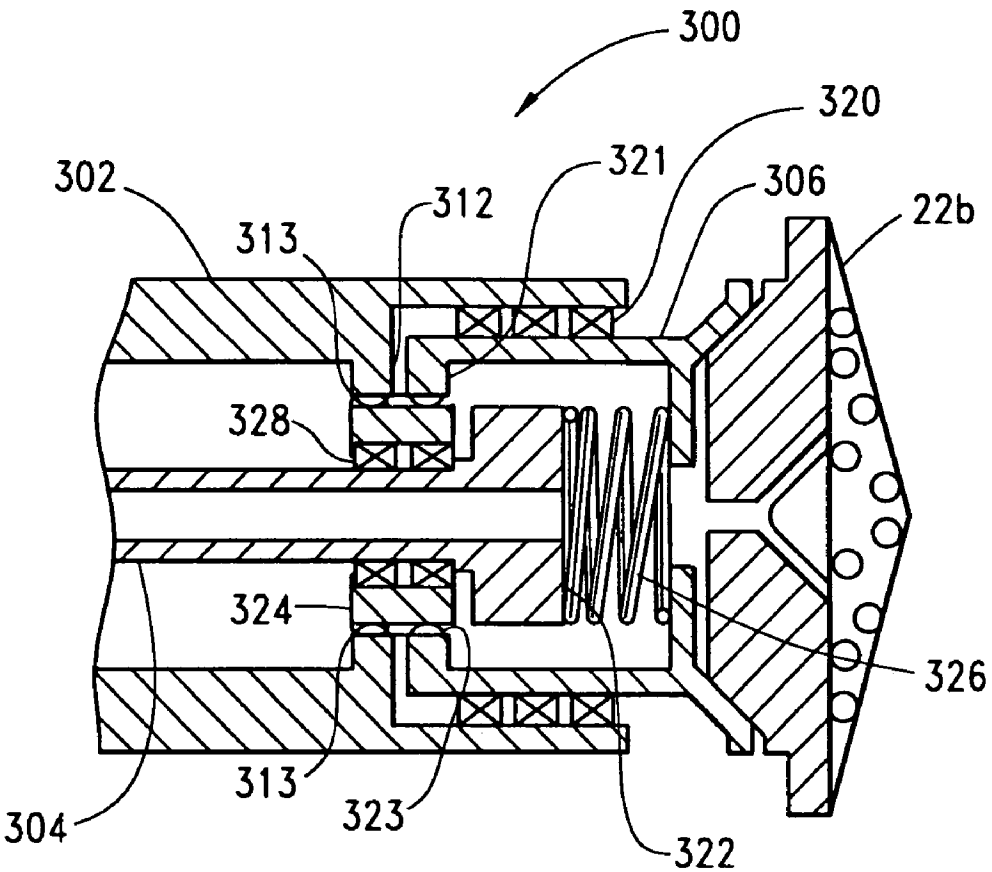

Another preferred coupling assembly 300 for use with the drive system 250 (shown in FIG. 12) is illustrated in FIG. 13*a*. The coupling assembly 300 is adapted to be connected, in a manner yet to be described, to the inner member 40 and the outer member 42 of the pipe section 30 at the downhole end 76 of the drill string 20 (see, for example, FIGS. 5 and 8). Preferably, an opposing end of the coupling assembly 300 is connected to a downhole tool 22*b*. The coupling assembly 300 of the embodiment shown in FIG. 13*a* will allow the rotation of the downhole tool 22*b* to be controlled by only the inner members 40 of the drill string 20, or by only the outer members 42 of the drill string, or by both the inner members and the outer members.

Preferably, the coupling assembly 300 comprises a housing 302, an inner drive shaft 304, a tool adapter 306 and a locking assembly 308. The housing 302 is preferably cylindrical and has an uphole end adapted to be connected to the outer member 42 at the downhole end 76 of the drill string 20. As with previous embodiments, the housing 302 preferably comprises a threaded pin end connection 310 for connection to the outer member 42 of the drill string 20. The housing 302 further defines an interior chamber, preferably comprising a collar 312. More preferably, the collar 312 comprises an interior set of splines 313 for purposes yet to be described.

The inner drive shaft 304 is preferably cylindrical and disposed generally coaxially within the housing 302. An uphole end of the inner drive shaft 304 is adapted to be connected to the inner member 40 at the downhole end 76 of the drill string 20. As with previous embodiments, the drive shaft 304 comprises a box end connection 314 for receiving the geometrically shaped pin end 70 of the inner member 40. The drive shaft 304 preferably extends through the housing 302 to or just beyond the collar 312. The drive shaft 304 may also comprise fluid ports (not shown) to facilitate the flow of drilling fluid from the drill string 20 to the downhole tool 22*b*.

The tool adapter 306 is disposed at an open downhole end 315 of the housing 302 and comprises a cylindrical open ended chamber 316 and a tool connector 318. Preferably, the cylindrical open ended chamber 316 is sized to be received in the open end 315 of the housing. More preferably, the chamber 316 of the adapter 306 is rotatably supported in the housing 302 by a seal and bearing arrangement 320. The chamber 316 preferably comprises a collared end 321 that is aligned with the collar 312 of the housing 302. More preferably, the collared end 321 of the chamber 316 comprises an interior set of splines 323 for a purpose yet to be described.

The tool connector 318 is configured to connect to the downhole tool 22*b*. Preferably, the downhole tool 22*b* is threaded onto the connector 318. However, alternative arrangements are anticipated, such as using pins or screws to secure the tool 22*b* to the connector 318. Alternatively, the downhole tool 22*b* may be integrally formed with the tool adapter 306 and the coupling assembly 300.

The locking assembly 308 functions to couple the tool adapter 306 and the downhole tool 22*b* to the inner drive shaft 304, to the housing 302, or to both. The assembly preferably comprises a forward spline arrangement 322, an aft spline arrangement 324, and a biasing member 326. The forward spline arrangement 322 is secured to the inner drive shaft 304, preferably at a downhole end of the shaft. The aft spline arrangement 324 is disposed around and rotatably supported by the inner drive shaft 304, adjacent to the forward spline arrangement 322. Preferably, the aft spline arrangement 324 is supported around the inner drive shaft 304 by a bearing arrangement 328.

In the preferred embodiment the biasing member 326 is a spring, although other biasing mechanisms could also be used. The biasing member 326 is positioned in the chamber 316 of the tool adapter 306, and exerts pressure on the forward spline arrangement 322 and the inner drive shaft 304 in an uphole direction. The biasing member 326, in conjunction with the drive system 250, serves to position the spline arrangements 322 and 324 in preferably three operating positions within the coupling assembly 300.

In a first position, shown in FIG. 13*a*, the piston and cylinder assembly 262 of the drive system 250 (see FIG. 12) is retracted, allowing the spring of the biasing member 326 to extend and force the spline arrangements 322 and 324 to move in the uphole direction. In this first position, the forward spline arrangement 322 is aligned and in operative contact with the splines 313 on both the collar 312 of the housing 302 and the splines 323 on the collared end 321 of the tool adapter 306. The housing 302, then, is torsionally locked first to the forward spline 322 and the inner drive shaft 304, and, as a result, to the tool adapter 306 and the downhole tool 22*b*. The coupling assembly 300 thus allows the drilling machine 12 to operate such that the torque from both the inner drive shaft 256 and the outer drive shaft 258 of the drive system 250 are transferred to the downhole tool 22*b*.

In a second position, shown in FIG. 13*b*, the piston and cylinder assembly 262 (see FIG. 12) would be partially extended, forcing the inner members 40 of the drill string 20 to axially advance with respect to the outer members 42. The movement of the inner members 40 also causes the inner drive shaft 304 and the spline arrangements 322 and 324 to advance, partially compressing the biasing member 326. In this second position, the forward spline arrangement 322 is aligned with the splines 323 on the collared end 321 of the tool adapter 306. The aft spline arrangement 324 is aligned with the splines 313 on the collar 312 of the housing 302. Only the inner drive shaft 304, and consequently the inner members 40 of the drill string 20, is operatively connected in torque transmitting engagement to the downhole tool 22*b*. Rotation of the housing 302 does not result in any torque being transmitted to the downhole tool 22*b* because the bearing arrangement 328 with the aft spline 324 and the bearing arrangement 320 around the tool adapter 306 permit the housing to rotate independently of the downhole tool 22*b*. The coupling assembly 300 thus allows the drilling machine 12 to operate in a conventional mode where rotation of the downhole tool 22*b* is controlled exclusively by the inner drive shaft 256 of the drive system 250.

In a third position, shown in FIG. 13*c*, the piston and cylinder assembly 262 (see FIG. 12) is fully extended, forcing the inner members 40 of the drill string 20 to axially advance with respect to the outer members 42. The movement of the inner members 40 also causes the inner drive shaft 304 and the spline arrangements 322 and 324 to axially advance, further compressing the biasing member 326. In this third position, the aft spline arrangement 324 is aligned with the splines 323 on the collared end 321 of the tool adapter 306 and with the splines 313 on the collar 312 of the housing 302. This arrangement permits the housing 302, and consequently the outer members 40 of the drill string 20, to be operatively connected in torque transmitting engagement to the downhole tool 22*b*. Rotation of the inner drive shaft 304 does not result in any torque being transmitted to the downhole tool 22*b* because the forward spline arrangement 322 is not engaged with either spline 313 or 323, and bearing arrangement 328 with the aft spline 324 permits the inner drive shaft to rotate independently of the downhole tool 22*b*. The coupling assembly 300 thus allows the drilling machine 12 to operate such that rotation of the downhole tool 22*b* is controlled exclusively by the outer drive shaft 256 of the drive system 250.

Figure 14:
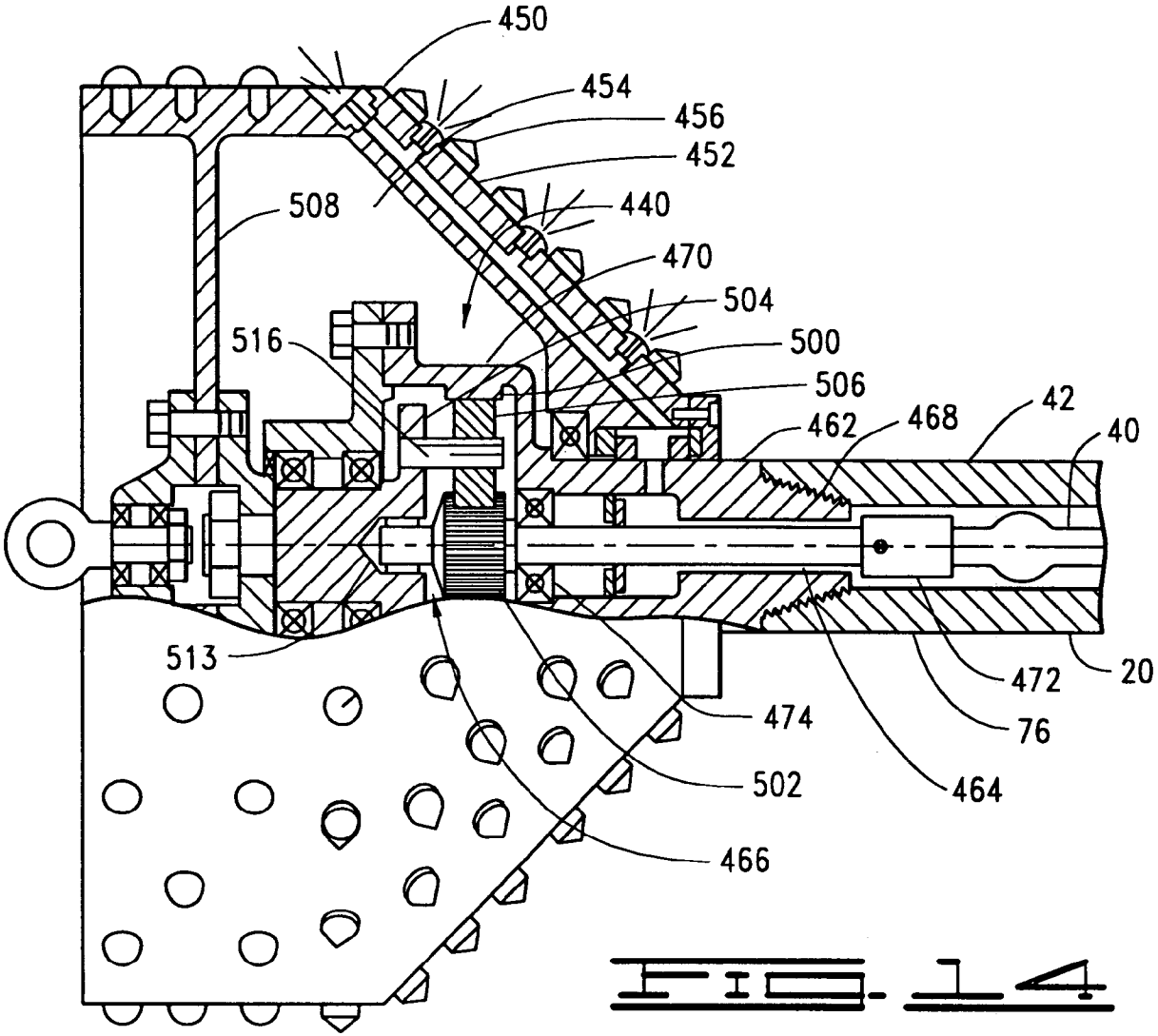
FIG. 14 is a partial cross-sectional and partial side elevational view of a coupling assembly comprising a planetary gear system housed in a backreaming tool.

With reference now to FIG. 14, there is shown therein an alternative embodiment for a coupling assembly 440 constructed in accordance with the present invention. The coupling assembly 440 is connected to the inner member 40 and the outer member 42 of the pipe section 30 at the downhole end 76 of the drill string 20. The coupling assembly 440 is preferably housed within a downhole tool 450, shown in FIG. 14 as a backreamer for use during a backreaming operation. The downhole tool 450 comprises an outer wall 452 defining an interior tool chamber 454. The outer wall 452 may be configured to have a plurality of cutting elements 456 such as carbide cutters, cutting teeth, etc. interspersed on its surface. The interior tool chamber 454 houses the coupling assembly 440 and facilitates connection to the drill string 20.

The coupling assembly 440 comprises an outer drive shaft 462, an inner drive shaft 464 and a gear mechanism 466. Preferably, the gear mechanism 466 is a planetary gear system and is adapted to operatively connect the outer drive shaft 462 and the inner drive shaft 464 to the downhole tool 450 individually or in combination. The planetary gear system 466 provides a gear reduction for the downhole tool 450. With gear reduction, the output speed of the downhole tool 450 may be relatively low compared to the output speed of the dual member drill string 20. However, high torque may be transmitted to the downhole tool 450 by the drill string 20 with a planetary gear system 466.

The outer drive shaft 462 has an uphole end adapted to be connected to the outer member 42 at the downhole end 76 of the drill string 20. Preferably, the uphole end comprises a threaded pin end connector 468 for connection to the box end of the outer member 42. The outer drive shaft 462 also comprises a gear connector 470 adapted to connect with the planetary gear system 466.

The inner drive shaft 464 is preferably cylindrical and is disposed generally coaxially within the outer drive shaft 462. An uphole end of the inner drive shaft 464 is adapted to be connected to the inner member 40 at the downhole end 76 of the drill string 20. Preferably, the inner drive shaft 464 comprises a box end connector 472 extending beyond the pin end connector 468 of the outer drive shaft 462 for receiving the pin end of the inner member 40 in torque transmitting engagement. The inner drive shaft 464 is preferably retained within the outer drive shaft 462 by bearings 474 and extends into the interior tool chamber 454. The bearings 474 permit the inner drive shaft 464 to rotate independently of the outer drive shaft 462.

The planetary gear system 466 is disposed within the interior tool chamber 454 and is operatively connected to the outer drive shaft 462 and the inner drive shaft 464. Preferably, the planetary gear system 466 comprises four major elements: an outer ring gear 500, a center sun gear 502, a carrier 504 and one or more planet gears 506. The planet gears 506 are situated between the sun gear 502 and the ring gear 500 and are held by the planet carrier 504. Additionally, the sun gear 502 and the planet gears 506 may be held together by a connecting member such as a band (not shown) that is connected to a central axis of the sun gear and a central axis of the ring gear. The connecting member functions to keep the sun gear 502 and the planet gear 506 in the same plane.

The sun gear 502 preferably is connected to the inner drive shaft 462 in torque-transmitting engagement. More preferably, the sun gear 502 is disposed around the inner drive shaft 462 at the end of drive shaft extending into the tool chamber 454. The sun gear 502 will rotate with the inner drive shaft 462 at the same rotational speed as the inner drive shaft.

The ring gear 500 is operatively connected to the gear connector 470 of the outer drive shaft 462. Preferably, the gear connector 470 comprises geared teeth on an inner surface of the connector. A corresponding arrangement of teeth on an outer circumference of the ring gear 500 permits the ring gear to rotate with the outer drive shaft 462.

The carrier 504 is secured to the downhole tool 450. Preferably, the carrier 504 is bolted or screwed to a plate 508 in the interior tool chamber 454 of the downhole tool 450. An opposing end of the planet carrier 504 forms a recess 513 that receives the front portion 482 of the inner drive shaft 462 supported on the bearings 480. The carrier 504 is connected to a central axis of each planet gear 506. Preferably, a plurality of shafts 516 are secured to the carrier 504 and pass through the central axis of the planet gears 506. The shafts 516 are supported in each of the planet gears 506 by bearings (not shown), permitting independent rotation of the planet gears relative to the carrier.

With continued reference to FIG. 14, the planetary gear system 466 operates with the sun gear 502 functioning as the driver or input gear of the planetary gear system. Each planet gear 506 rotates about its central axis and is driven by the sun gear 502. Additionally, the ring gear 500 intermeshes with the planet gears 506 through the set of gear teeth on the inner circumference of the ring gear and an outer circumference of the planet gear to cause the planet gears to travel around the sun gear 502. The carrier 504, by its attachment to the axis of the planet gears 506, will rotate with the planet gears as they rotate around the sun gear 502. In the preferred configuration of the planetary gear mechanism 466 shown in FIG. 14, the carrier 504 is the output device for taking power out of the planetary gear system 466.

In operation, the planetary gear system 466 preferably provides increased torque output to the downhole tool 450 as the speed of the inner members 40 and the outer members 42 of the drill string 20 are varied. As the inner members 40 are rotated, the sun gear 502, connected to the inner drive shaft 464, will also rotate with the inner members. The rotation of the sun gear 502 drives the planet gears 506. The planet gears 506 will be driven around the sun gear 502, traveling on the intermeshing gear teeth 508 between the ring gear 500 and planet gears 506. The rotation of the planet gears 506 will drive the carrier 504 to rotate in a direction opposite to that of the sun gear 502. The operation of the planetary gear system 466 will cause the downhole tool 450 to rotate at a reduced speed and increased torque in comparison to the inner drive shaft 462. Thus the downhole tool 450 attached to the carrier 504 is able to excavate the soil at an increased torque output as compared to a downhole tool that is not connected to a planetary gear system.

One skilled in the art will appreciate the resultant torque output can be affected by changing the number of teeth in the planetary gear system 466 and by altering the relative rotation rate of both the drive shafts 462 and 464. Additionally, different gear ratios using the planetary gear system 466 may also be produced by varying which gear is used as the input, which gear is used as the output and which gear is held still.

Further, it may be noted that while the above discussion describes the utilization of the planetary gear system 466 for providing increased torque output for transmission to downhole tool 450 such as a backreamer during backreaming operations, the same process may be adapted to be utilized for other downhole tools, such as tricone bits during drilling operations. Additionally, other gear systems or sets, such as bevel gear drives, planocentric drive, mutating gears, harmonic drives, and spur gears, among others, may be used to operate similarly to the planetary gear system 466.

Figure 15:
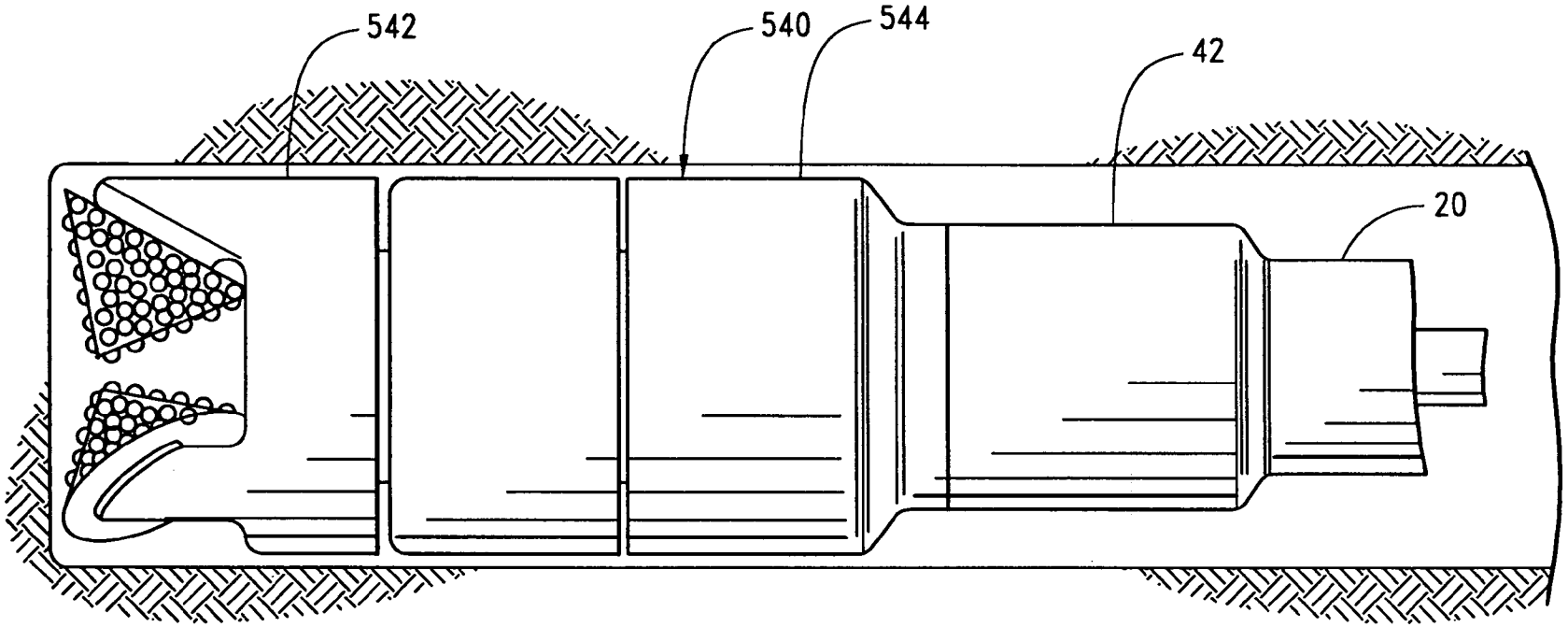
FIG. 15 is a depiction of a planetary drive housing assembly comprising a planetary gear system to drive a downhole boring tool.
Figure 15:
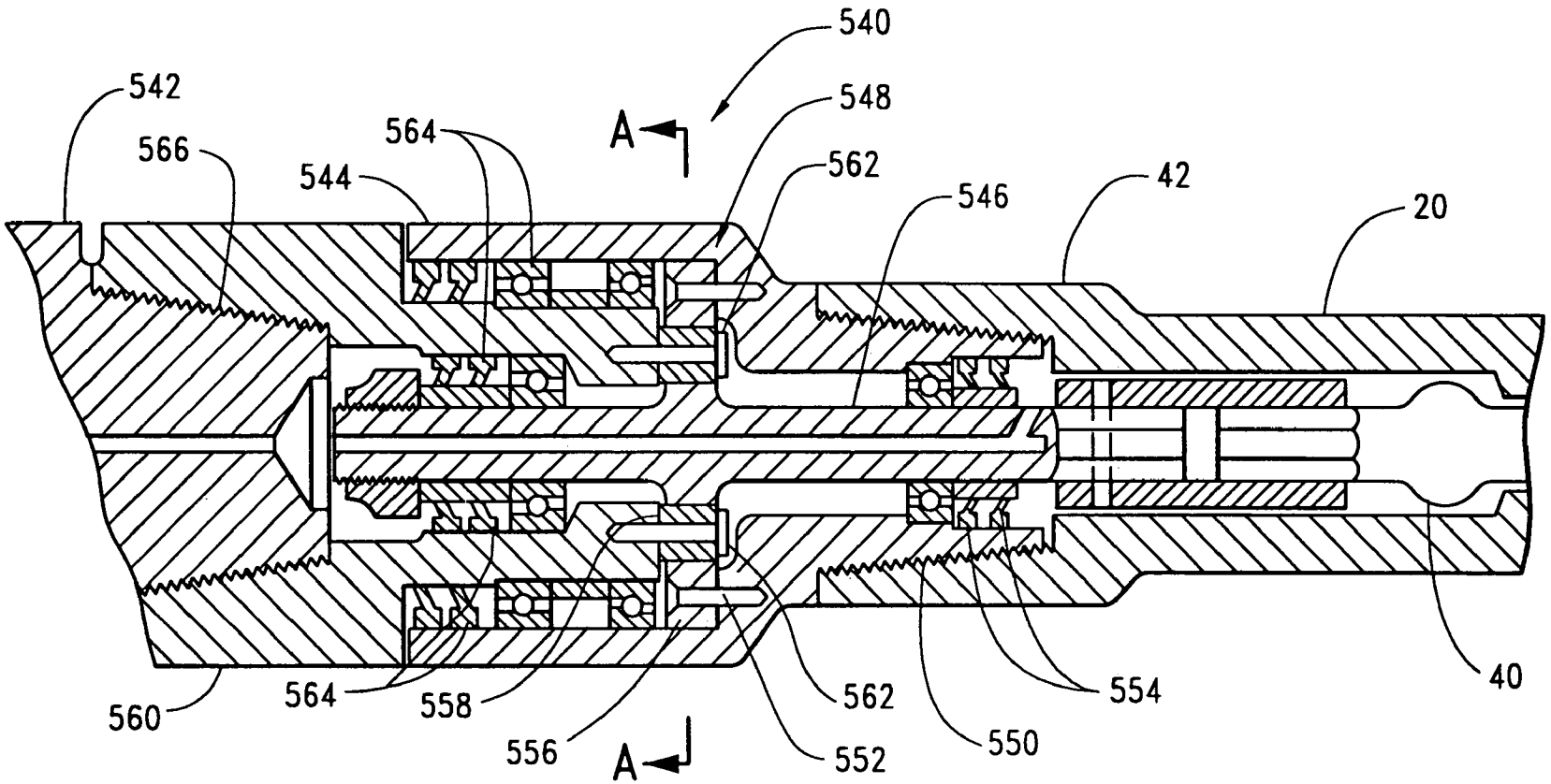

With reference now to FIGS. 15 and 16, there is shown therein an alternative for the coupling assembly 540 of the present invention for use with a downhole tool, such as a boring tool 542. Preferably, the coupling assembly 540 comprises an outer drive 544, an inner drive 546, and a planetary gear system 548. More preferably, the gear system 548 is similar to the gear mechanism 466 described for use with a backreamer tool in FIG. 14, and is adapted to operatively connect the outer drive 544 and the inner drive 546 to the boring tool 542 individually or in combination.

The outer drive 544 has an uphole end 550 adapted to be connected to the outer member 42 of the drill string 20. The outer drive 544 also comprises a gear connector 552 adapted to connect with the gear system 548. The inner drive 546 is preferably disposed generally coaxially within the outer drive 544 and has an uphole end adapted to be connected to the inner member 40 of the drill string 20. A series of bearings and seals 554 are preferably used to retain the inner drive 546 within the outer drive 544, such that the inner drive may rotate independently of the outer drive.

Figure 17:
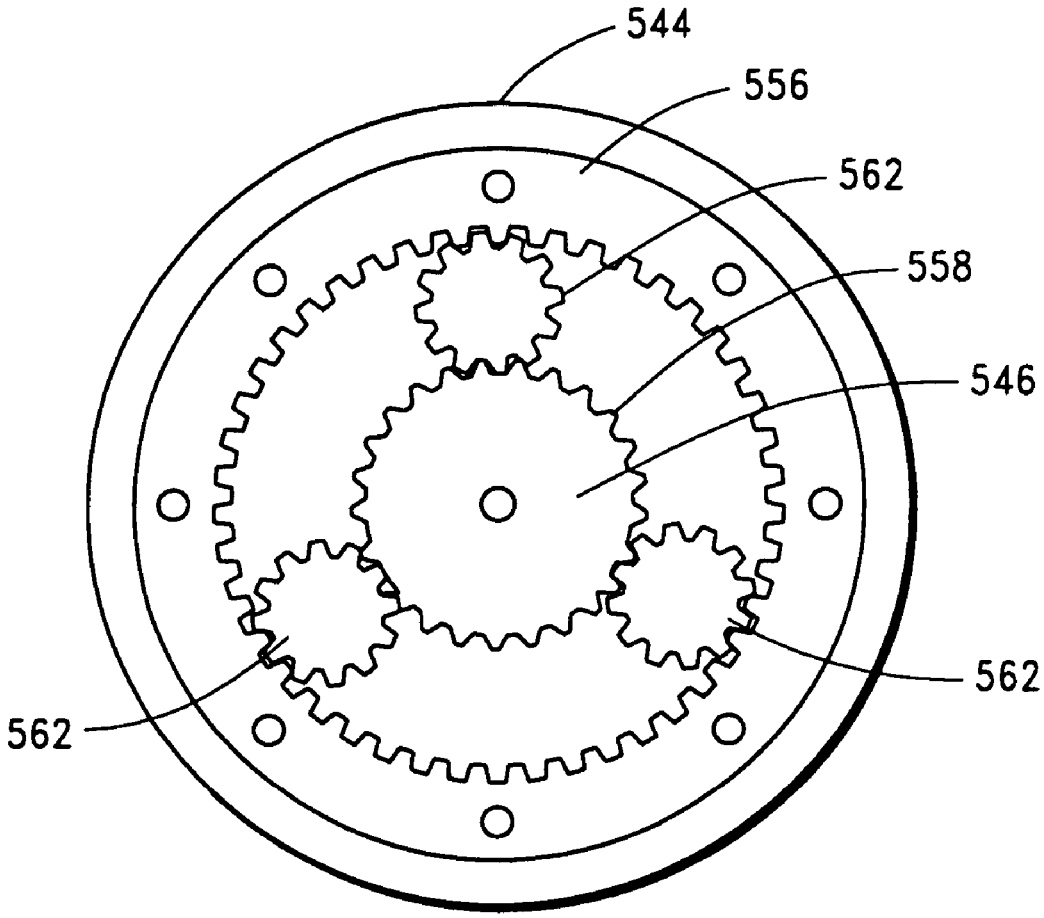
FIG. 17 is a cross-sectional view of the planetary drive housing assembly of FIG. 16 taken along cut-line A—A.

With continued reference to FIG. 16 and with reference to FIG. 17, the gear system 548 of the present embodiment comprises an outer ring gear 556, a center sun gear 558, a carrier 560, and at least one planet gear 562. Preferably, the ring gear 556 is connected to the gear connector 552 of the outer drive 544 for rotational movement with the outer drive. The sun gear 558 is preferably connected to the inner drive 546 in torque-transmitting engagement. More preferably, the sun gear 558 is disposed around the inner drive 546 and will rotate with the inner drive.

The planet gears 562 are held by the carrier 560 and are preferably situated between the ring gear 556 and the sun gear 558. Additional sets of seals and bearings 564 permit the carrier 560 to be retained and rotate with respect to the outer drive 544 and the inner drive 546 The carrier 560 is also adapted to be connected to the boring tool 542. As shown in FIG. 16, the carrier 560 has a downhole end 566 for threaded connection to the boring tool 542. Alternatively, the carrier 560 and the boring tool 542 could be integrally formed or operatively connected by other means.

The present invention thus provides a mechanism to control and improve performance of the downhole tool, when employing a dual member drill string. The inner and outer members of the dual member drill string are connected to the downhole tool through a coupling assembly at a downhole end of the drill string. The coupling assembly is adapted to receive torque input from both the inner members and the outer members of the dual member drill string to generate a resultant increased torque output of the downhole tool. This enables the downhole tool to advance through the rock face without "hanging up" against the rock race. Additionally, wear on the dual member drill string is limited because as the downhole tool has the torque needed to advance through the rock face, "wind-up" of the pipe sections in a long bore does not occur.

It is clear that the present invention is well adapted to attain the ends and advantages mentioned as well as those inherent therein. While the presently preferred embodiments of the invention have been described for purposes of this disclosure, it will be understood that numerous changes may be made in the combination and arrangement of the various parts, elements and procedures described herein without departing from the spirit and scope of the invention as defined in the following claims.

What is claimed is:

1. A system of pipe sections comprising:

a drill string comprising:

a rotatable outer member; and a rotatable inner member situated within the outer member; and a coupling assembly connected to the inner member and the outer member at a point along the drill string, the coupling assembly adapted to transmit torque between the outer member and the inner member at a downhole end of the drill string;

wherein the coupling assembly is characterized by a plurality of fluid passages to permit fluid to enter a downhole tool.

2. The system of claim 1 wherein the drill string comprises a plurality of pipe sections disposed in end-to-end torque transmitting engagement, each pipe section comprising:

a rotatable outer member; and a rotatable inner member situated within the outer member.

3. The system of claim 2 further comprising a drive system operably connectable to the inner member and the outer member of the pipe section at an uphole end of the drill string and adapted to drive rotation of the inner member and the outer member of the drill string independently of one another.

4. The system of claim 3 wherein the drive system comprises:

a plurality of rotary drive devices;

wherein the inner member and the outer member of the pipe section at the uphole end of the drill string are each operably connectable to one of the plurality of rotary drive devices; and a feedback control system operably connectable to the plurality of rotary drive devices to indicate when each member is rotating at substantially the same rotational speed; and wherein the coupling assembly transmits torque from both the inner member and the outer member to a downhole tool when the inner member and the outer member are rotated at substantially the same rotational speed.

5. The system of claim 3 wherein the coupling assembly is adapted to couple the inner member and the outer member when the outer member is rotated at a rotational speed that substantially matches or exceeds the rotational speed of the inner member.

6. The system of claim 5 wherein when the outer member and the inner member are coupled by the coupling assembly, the torque from both the inner member and the outer member is transmitted to a downhole tool.

7. The system of claim 5 wherein the coupling assembly comprises:

a clutch mechanism having an engaged mode in which the coupling assembly transmits torque between the outer member and the inner member, and a disengaged mode in which torque is not transmitted between the inner member and the outer member; and wherein the clutch mechanism is actuable into its engaged mode when the rotational speed of the outer member substantially matches or exceeds the rotational speed of the inner member.

8. The system of claim 7 wherein the clutch mechanism is configured in its disengaged mode when the rotational speed of the outer member is less than the rotational speed of the inner member.

9. The system of claim 8 wherein transmission of torque between the inner member and the outer member is disabled while the clutch mechanism is in its disabled mode.

10. The system of claim 5 wherein the coupling assembly comprises:

an outer drive shaft having a body defining an interior operating chamber, the outer drive shaft being in torque transmitting engagement at one end with the outer member of the pipe section at the downhole end of the drill string and at an opposing end being connected to a downhole tool;

an inner drive shaft having a body that is disposed within the interior operating chamber, the inner drive shaft being in torque transmitting engagement at one end with the inner member of the pipe section at the downhole end of the drill string and being in torque transmitting engagement at an opposing end with the downhole tool; and a clutch mechanism connected to the inner drive shaft and adapted to interconnect the inner drive shaft with the outer drive shaft in torque transmitting engagement when the outer drive shaft is rotated at a rotational speed that substantially matches or exceeds the rotational speed of the inner drive shaft.

11. The system of claim 10 wherein the clutch mechanism permits both the inner drive shaft and the outer drive shaft to transmit torque to the downhole tool and is characterized by an engaged mode and a disengaged mode;

wherein the clutch mechanism is configured in its engaged mode when the rotational speed of the outer member substantially matches or exceeds the rotational speed of the inner member; and wherein the clutch mechanism is configured in its disengaged mode when the rotational speed of the outer member is less than the rotational speed of the inner member.

12. The system of 11 wherein the clutch mechanism comprises an over-running clutch.

13. The system of 11 wherein the clutch mechanism comprises a pawl clutch.

14. The system of claim 3 wherein the coupling assembly is adapted to couple the inner member and the outer member when the outer member is rotated at a rotational speed that is substantially equal to the rotational speed of the inner member.

15. The system of claim 1 wherein the coupling assembly is adapted to prevent relative rotary motion between the inner member and the outer member.

16. The system of claim 1 wherein the coupling assembly comprises a locking mechanism which maintains the inner member and the outer member in a coupled state in response to an axial movement of the inner member relative to the outer member, and which maintains the inner member and the outer member in an uncoupled state in response to a reverse axial movement of the inner member relative to the outer member.

17. The system of claim 16 wherein the locking assembly comprises a spline coupling between a spline formed on the inner drive shaft and a mating keyway formed in the outer drive shaft.

18. The system of claim 1 wherein the coupling assembly comprises:

an outer drive shaft having a body defining an interior operating chamber, the outer drive shaft being in torque transmitting engagement at one end with the outer member of the pipe section at the downhole end of the drill string and at an opposing being connected to a downhole tool;

an inner drive shaft having a body that is disposed within the interior operating chamber, the inner drive shaft being in torque transmitting engagement at one end with the outer member of the pipe section at the downhole end of the drill string, and being in torque transmitting engagement at an opposing end with the downhole tool; and a locking mechanism connected to the inner drive shaft and adapted to interconnect the inner drive shaft with the outer drive shaft in torque transmitting engagement when the inner drive shaft is moved axially relative to the outer drive shaft.

19. The system of claim 18 wherein the locking mechanism is adapted to maintain the inner drive shaft and the outer drive shaft in a coupled state when the inner drive shaft is moved axially relative to the outer drive shaft and wherein the axial movement is a downhole axial movement, and to maintain the inner drive shaft and the outer drive shaft in an uncoupled state when the inner drive shaft is moved axially relative to the outer drive shaft and wherein the axial movement is an uphole axial movement.

20. A system of pipe sections comprising:

a drill string comprising:

a rotatable outer member; and a rotatable inner member situated within the outer member; and a coupling assembly connected to the inner member and the outer member at a point along the drill string, the coupling assembly adapted to transmit torque between the outer member and the inner member at a downhole end of the drill string;

wherein the coupling assembly is characterized by an uphole end and a downhole end and wherein the uphole end of the coupling assembly comprises:

an inner drive connector adapted to be in torque transmitting engagement with the inner member of the pipe section; and an outer drive connector adapted to be connectable to the outer member of the pipe section.

21. The system of claim 20 wherein the inner drive connector is rigidly connectable to the outer drive connector.

22. The system of claim 20 wherein the inner drive connector and the inner member of the pipe section are connectable in a slip-fit connection.

23. The system of claim 22 wherein the inner member of the pipe section is slideably receivable within the inner drive connector.

24. The system of claim 20 wherein the outer drive connector and the outer member of the pipe section are threadably connectable.

25. The system of claim 20 wherein the downhole end of the coupling assembly is removably attachable to a downhole tool.

26. The system of claim 25 wherein the downhole tool comprises a pin end, and wherein the coupling assembly comprises a box end within which the pin end of the downhole tool may be threadably received.

27. The system of claim 25 wherein the coupling assembly comprises a pin end, and wherein the downhole tool comprises a box end within which the pin end of the coupling assembly is threadably received.

28. The system of claim 20 wherein the coupling assembly is integrally formed with a downhole tool.

29. A system for rotating a downhole tool comprising:

a drill string comprising:

a rotatable outer member; and a rotatable inner member situated within the outer member; and a coupling assembly having a first end and a second end, the second end being operably connectable to a downhole tool; and the first end being operably connectable to the inner member and the outer member at a downhole end of the drill string; and wherein the coupling assembly is adapted to receive a torque input from the inner member and a torque input from the outer member to generate a resultant torque output of the downhole tool.

30. The system of claim 29 wherein the drill string comprises a plurality of pipe sections disposed in end-to-end torque transmitting engagement, each pipe section comprising:

a rotatable outer member; and a rotatable inner member situated within the outer member.

31. The system of claim 30 further comprising at least one drive system adapted to drive rotation of the assembled inner members and the assembled outer members of the pipe section independently of one another.

32. The system of claim 31 wherein the coupling assembly comprises a gear mechanism, the gear mechanism being adapted to receive the torque input from an inner drive member of the drive system and the torque input from an outer drive member of the drive system to generate the resultant torque output of the downhole tool.

33. The system of claim 32 wherein the gear mechanism is housed within the downhole tool.

34. The system of claim 32 wherein the gear mechanism comprises a planetary gear system.

35. The system of claim 34 wherein the planetary gear system comprises:

a sun gear in torque transmitting engagement with the inner drive member;

a ring gear in torque transmitting engagement with the outer drive member; and a carrier in torque transmitting engagement with the downhole tool.

36. The system of claim 32 wherein the coupling assembly is adapted to generate a torque output to the downhole tool.

37. The system of claim 36 wherein the torque output of the downhole tool is a vector sum of a torque input of the inner member and a torque input of an outer member of the pipe section.

38. The system of claim 29 wherein the output speed is different than the input speed to the inner drive.

39. A horizontal boring system for use to drive a downhole tool comprising:

a horizontal boring machine having at least one drive system, the drive system characterized by a first end connected to the horizontal boring machine and a second end;

a plurality of pipe sections disposed in end-to-end engagement forming a drill string such that the pipe section at an uphole end of the drill string is connected to the second end of the drive system, each pipe section in the drill string comprising:

a rotatable outer member; and a rotatable inner member situated within the outer member;

wherein torque may be transmitted between the outer member of each pipe section and the outer member of an adjacent pipe section, and wherein torque may be transmitted between the inner member of each pipe section and the inner member of an adjacent pipe section; and a coupling assembly having a first end and a second end, the first end being operably connectable to a downhole tool and the second end being operably connectable to the inner member and the outer member of the pipe section at a downhole end of the drill string; and wherein the coupling assembly is adapted to receive a torque input from the inner member and a torque input from the outer member to generate a resultant torque output of the downhole tool.

* * * * *